US009966015B2

(12) United States Patent
Kurita

(10) Patent No.: US 9,966,015 B2
(45) Date of Patent: May 8, 2018

(54) LIGHT SOURCE APPARATUS, IMAGE DISPLAY APPARATUS AND CONTROL METHOD FOR LIGHT SOURCE APPARATUS

(71) Applicant: CANON KABUSHIKI KAISHA, Tokyo (JP)

(72) Inventor: Masanao Kurita, Isehara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 135 days.

(21) Appl. No.: 15/078,145

(22) Filed: Mar. 23, 2016

(65) Prior Publication Data

US 2016/0284283 A1 Sep. 29, 2016

(30) Foreign Application Priority Data

Mar. 26, 2015 (JP) ..... 2015-064872

(51) Int. Cl.
*G09G 5/10* (2006.01)
*G09G 3/34* (2006.01)
*G09G 3/20* (2006.01)

(52) U.S. Cl.
CPC ..... *G09G 3/3413* (2013.01); *G09G 3/2081* (2013.01); *G09G 3/3426* (2013.01); *G09G 2320/064* (2013.01); *G09G 2320/066* (2013.01); *G09G 2320/0666* (2013.01); *G09G 2330/021* (2013.01)

(58) Field of Classification Search
CPC combination set(s) only.
See application file for complete search history.

(56) References Cited

U.S. PATENT DOCUMENTS

2007/0211013 A1* 9/2007 Uehara ..... G09G 3/3413 345/102
2008/0007496 A1* 1/2008 Kim ..... G09G 3/3216 345/80
2010/0097412 A1* 4/2010 Okabe ..... G09G 3/3413 345/691
2014/0292223 A1* 10/2014 Hirasawa ..... H01L 27/3211 315/293
2016/0203774 A1* 7/2016 Ahn ..... G09G 3/3426 345/102

FOREIGN PATENT DOCUMENTS

JP 2001-142409 A 5/2001
JP 2010-060746 A 3/2010

* cited by examiner

*Primary Examiner* — Jennifer Mehmood
*Assistant Examiner* — Sosina Abebe
(74) *Attorney, Agent, or Firm* — Cowan, Liebowitz & Latman, P.C.

(57) ABSTRACT

A light source apparatus includes: a light-emitting unit having a plurality of light-emitting diodes having mutually different light emission colors; a setting unit configured to set a drive mode; and a control unit configured to drive the light-emitting unit in such that each of the plurality of light-emitting diodes emits light periodically, by a drive method corresponding to the drive mode set by the setting unit, wherein in a case where the light-emitting unit is lit with a predetermined light emission brightness, in a light-emitting diode from among the plurality of light-emitting diodes, a drive current value during a lighting period is lower and a lighting period during one cycle is longer in a second drive mode than those in a first drive mode.

16 Claims, 16 Drawing Sheets

*FIG. 3*

101

| | | | | | | |
|---|---|---|---|---|---|---|
| 111 (1,1) | 111 (1,2) | 111 (1,3) | 111 (1,4) | 111 (1,5) | 111 (1,6) | 111 (1,7) |
| 111 (2,1) | 111 (2,2) | 111 (2,3) | 111 (2,4) | 111 (2,5) | 111 (2,6) | 111 (2,7) |
| 111 (3,1) | 111 (3,2) | 111 (3,3) | 111 (3,4) | 111 (3,5) | 111 (3,6) | 111 (3,7) |
| 111 (4,1) | 111 (4,2) | 111 (4,3) | 111 (4,4) | 111 (4,5) | 111 (4,6) | 111 (4,7) |
| 111 (5,1) | 111 (5,2) | 111 (5,3) | 111 (5,4) | 111 (5,5) | 111 (5,6) | 111 (5,7) |

LIGHT SOURCE APPARATUS, IMAGE DISPLAY APPARATUS AND CONTROL METHOD FOR LIGHT SOURCE APPARATUS

BACKGROUND OF THE INVENTION

Field of the Invention

The present invention relates to a light source apparatus, an image display apparatus and a control method for a light source apparatus.

Description of the Related Art

There are color image display apparatuses including a color liquid-crystal panel having a color filter and a light source apparatus (backlight apparatus) which irradiates white light onto the rear surface of the color liquid-crystal panel. Conventionally, a fluorescent lamp, such as a cold-cathode fluorescent lamp (CCFL), or the like, is mainly used as a light source for a light source apparatus. However, in recent years, light-emitting diodes (LED), which are excellent in terms of power consumption, lifespan, color reproduction and environmental burden, have come to be used as a light source for light source apparatuses.

A light source apparatus which uses an LED as a light source (LED backlight apparatus) generally has a plurality of LEDs. Japanese Patent Application Publication No. 2001-142409 discloses an LED backlight apparatus having a plurality of light-emitting blocks. The light-emitting blocks each have one or more LED. Furthermore, Japanese Patent Application Publication No. 2001-142409 indicates that the light emission brightness of each of the plurality of light-emitting blocks is controlled individually.

By reducing the light emission brightness of light-emitting blocks which irradiate light onto a low-brightness display region of the screen of the color image display apparatus, it is possible to reduce the power consumption and to improve the contrast of the display image (the image displayed on the screen). A low-brightness display region is a region where a dark image is displayed. Furthermore, by increasing the light emission brightness of the light-emitting blocks which irradiate light onto a high-brightness display region of the screen, it is possible to improve the contrast of the display image, and it becomes possible to portray glare and sparkle that could not be portrayed conventionally. A high-brightness display region is a region where a bright image is displayed. By reducing the light emission brightness of the light-emitting blocks which irradiate light onto the low-brightness display region and raising the light emission brightness of the light-emitting blocks which irradiate light onto the high-brightness display region, it is possible to further improve the contrast of the display image. The light emission control of the respective light-emitting blocks corresponding to the characteristics of the image is called "local dimming control". Furthermore, local dimming control which raises the light emission brightness of the light-emitting blocks that irradiates light onto the high-brightness display region is called "high dynamic range (HDR) control".

In general, it is desirable for the power consumption of the apparatus to be small. As described above, there is local dimming control which is capable of reducing the power consumption. However, light source apparatuses are not necessarily capable of carrying out local dimming control of this kind. Furthermore, the user may not necessarily want local dimming control. Therefore, a new method is required which is capable of reducing the power consumption even when local dimming control is not carried out.

SUMMARY OF THE INVENTION

The present invention provides technology capable of reducing the power consumption of a light source apparatus, without carrying out local dimming control.

The present invention in its first aspect provides a light source apparatus, comprising:

a light-emitting unit having a plurality of light-emitting diodes having mutually different light emission colors;

a setting unit configured to set any of a plurality of drive modes including a first drive mode and a second drive mode having mutually different drive methods for the light-emitting unit; and a control unit configured to drive the light-emitting unit in such that each of the plurality of light-emitting diodes emits light periodically, by a drive method corresponding to the drive mode set by the setting unit, wherein in a case where the light-emitting unit is lit with a predetermined light emission brightness, in a light-emitting diode from among the plurality of light-emitting diodes, a drive current value during a lighting period is lower and a lighting period during one cycle is longer in the second drive mode than those in the first drive mode.

The present invention in its second aspect provides an image display apparatus, comprising:

a light source apparatus; and a display unit configured to display an image on a screen by modulating light from the light source apparatus on the basis of input image data, wherein the light source apparatus comprises

- a light-emitting unit having a plurality of light-emitting diodes having mutually different light emission colors,
- a setting unit configured to set any of a plurality of drive modes including a first drive mode and a second drive mode having mutually different drive methods for the light-emitting unit, and
- a control unit configured to drive the light-emitting unit in such that each of the plurality of light-emitting diodes emits light periodically, by a drive method corresponding to the drive mode set by the setting unit; and in a case where the light-emitting unit is lit with a predetermined light emission brightness, in a light-emitting diode from among the plurality of light-emitting diodes, a drive current value during a lighting period is lower and a lighting period during one cycle is longer in the second drive mode than those in the first drive mode.

The present invention in its third aspect provides a control method for a light source apparatus including a light-emitting unit having a plurality of light-emitting diodes having mutually different light emission colors, comprising:

setting any of a plurality of drive modes including a first drive mode and a second drive mode having mutually different drive methods for the light-emitting unit; and driving the light-emitting unit in such that each of the plurality of light-emitting diodes emits light periodically, by a drive method corresponding to the drive mode set by the setting, wherein in a case where the light-emitting unit is lit with a predetermined light emission brightness, in a light-emitting diode from among the plurality of light-emitting diodes, a drive current value during a lighting period is lower and a lighting period during one cycle is longer in the second drive mode than those in the first drive mode.

The present invention in its fourth aspect provides a non-transitory computer readable medium that stores a program, wherein the program causes a computer to execute a control method for a light source apparatus including a light-emitting unit having a plurality of light-emitting diodes having mutually different light emission colors;

the control method comprises setting any of a plurality of drive modes including a first drive mode and a second drive mode having mutually different drive methods for the light-emitting unit, and driving the light-emitting unit in such that each of the plurality of light-emitting diodes emits light periodically, by a drive method corresponding to the drive mode set by the setting; and in a case where the light-emitting unit is lit with a predetermined light emission brightness, in a light-emitting diode from among the plurality of light-emitting diodes, a drive current value during a lighting period is lower and a lighting period during one cycle is longer in the second drive mode than those in the first drive mode.

According to the present invention, it is possible to reduce the power consumption of a light source apparatus, without carrying out local dimming control.

Further features of the present invention will become apparent from the following description of exemplary embodiments with reference to the attached drawings.

BRIEF DESCRIPTION OF THE DRAWINGS

FIG. 3 shows one example of the arrangement of a light-emitting block relating to the first embodiment;

DESCRIPTION OF THE EMBODIMENTS

First Embodiment

Below, a light source apparatus, a display apparatus and a control method for same relating to a first embodiment of the present invention will be described.

In the present embodiment, an example of a light source (backlight apparatus) for a color image display apparatus is described, but the liquid source apparatus is not limited to this. The light source apparatus may be a lighting apparatus, such as a street lamp, indoor lighting, microscope illumination, or the like.

Furthermore, in the present embodiment, an example is described in which the image display apparatus is a transmission-type liquid-crystal display apparatus, but the image display apparatus is not limited to this. The image display apparatus may have a light source apparatus and a display unit which displays an image on a screen by modulating light from the light source apparatus on the basis of input image data (image data input to the image display apparatus). For example, the image display apparatus may be a reflection-type liquid-crystal display apparatus. Furthermore, the image display apparatus may be a display using a MEMS shutter method which employs a micro electromechanical system (MEMS) shutter, rather than liquid-crystal elements. The image display apparatus may be a monochromatic image display apparatus.

Figure 1:
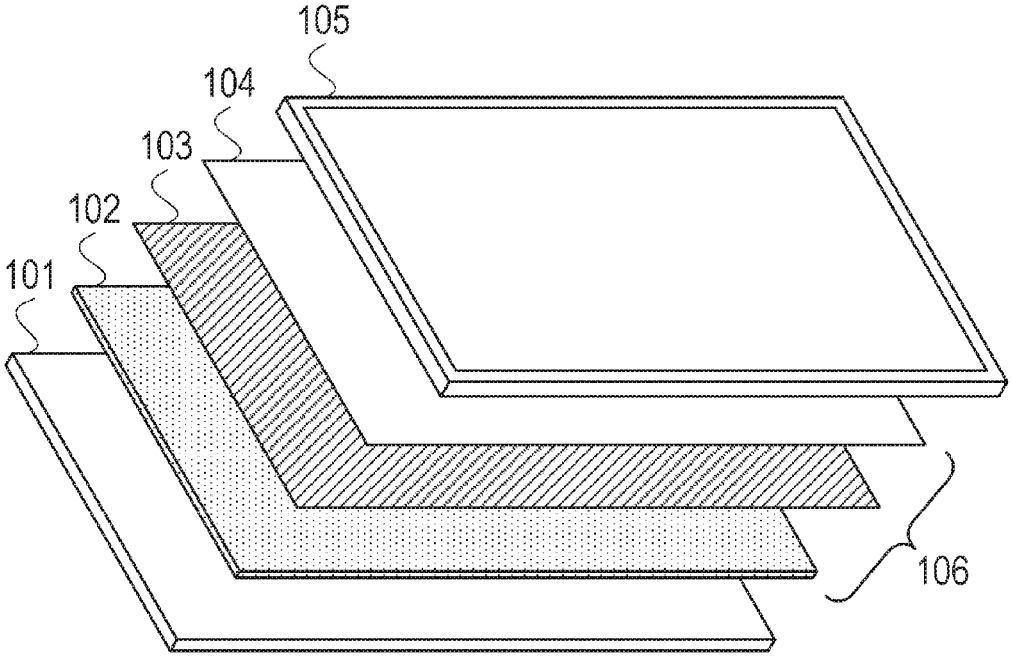
FIG. 1 shows one example of the configuration of a color image display apparatus relating to a first embodiment.

FIG. 1 is a schematic drawing showing one example of the configuration of a color image display apparatus relating to the present embodiment. The color image display apparatus includes a backlight apparatus and a color liquid-crystal panel 105. The backlight apparatus includes a LED substrate 101, a diffusion plate 102, a condensing sheet 103, a reflection-type polarizing film 104, and the like.

The LED substrate 101 emits light (for example, white light) which is irradiated onto the rear surface of the color liquid-crystal panel 105. There are no particular restrictions on the light emission color of the LED substrate 101. A plurality of light-emitting diodes (LEDs) are provided on the LED substrate 101. The diffusion plate 102, the condensing sheet 103 and the reflection-type polarizing film 104 are provided at positions opposing the LED. The diffusion plate 102, the condensing sheet 103 and the reflection-type polarizing film 104 are arranged substantially in parallel (or completely in parallel) with the LED substrate 101, and apply optical changes to the light from the LED substrate 101 (more specifically, from the LEDs). More specifically, the diffusion plate 102 causes the LED substrate 101 to function as a surface light source, by diffusing the light from the plurality of LEDs. The condensing sheet 103 improves the front surface brightness (the brightness in the front surface direction), by condensing, in the front surface direction (the side of the color liquid-crystal panel 105), the light that has been diffused by the diffusion plate 102 and which is incident on the condensing sheet 103 at various angles of incidence. The reflection-type polarizing film 104 improves the front surface brightness by efficiently polarizing the incident light.

The diffusion plate 102, condensing sheet 103 and reflection-type polarizing film 104 are used in superimposed fashion. Below, these optical members are jointly referred to as an optical sheet 106. The optical sheet 106 may include members other than the optical members described above, and furthermore, may omit at least one of the optical members described above. Moreover, the optical sheet 106 and the color liquid-crystal panel 105 may be configured in an integrated fashion.

The color liquid-crystal panel 105 is a display unit which displays an image on the screen by modulating light from the backlight apparatus. More specifically, the color liquid-crystal panel 105 has a plurality of R sub-pixels which transmit red light, G sub-pixels which transmit green light, and B sub-pixels which transmit blue light. The color liquid-crystal panel 105 controls the transmissivity of the irradiated light, respectively in each sub-pixel. Therefore, the brightness of irradiated light is controlled respectively in each sub-pixel and a color image is displayed.

The backlight apparatus having the configuration described above (a configuration such as that shown in FIG. 1) is generally called a direct-surface-type backlight light.

Figure 2:
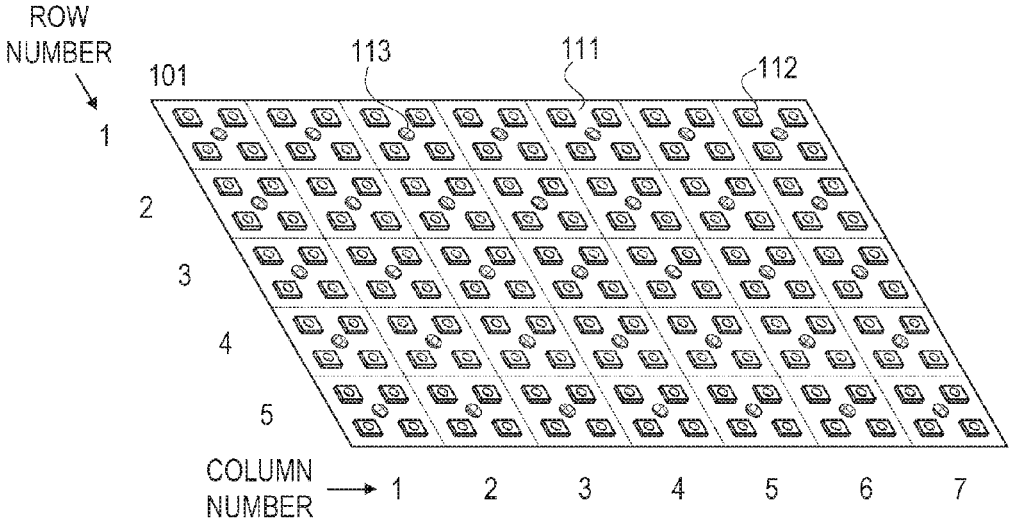
FIG. 2 shows one example of the configuration of an LED substrate relating to the first embodiment.

FIG. 2 is a schematic drawing showing an example of a configuration of the LED substrate 101. The LED substrate 101 has a plurality of light-emitting blocks 111 which respectively correspond to a plurality of partial regions in the region of the light-emitting surface of the backlight apparatus. The "plurality of partial regions in the region of the light-emitting surface of the backlight apparatus" could be interpreted as "a plurality of partial regions in the region of the screen of the color image display apparatus". In the example in FIG. 2, the LED substrate 101 has thirty-five light-emitting blocks 111 disposed in a matrix fashion in five rows by seven columns. The light emission brightness of each light-emitting block 111 can be controlled individually. The light emission color of each light-emitting block 111 can also be controlled individually.

A plurality of LEDs 112 having mutually different light emission colors are provided in the light-emitting blocks 111. In the example in FIG. 2, a total of four LEDs 112 in two rows and two columns are provided in each of the light-emitting blocks 111. More specifically, one R-LED, two G-LEDs and one B-LED are provided in each light-emitting block. The R-LED is an LED which emits red light, the G-LED is an LED which emits green light and the B-LED is an LED which emits blue light. In the present embodiment, an indium-gallium-aluminum-phosphorous type (InGaAlP-type) semiconductor LED is used as the R-LED, and a gallium nitride type (GaN-type) semiconductor LED is used as the G-LED and B-LED.

An optical sensor 113 (detection unit) is provided in each of the light-emitting blocks 111. The optical sensor 113 detects light from the light-emitting block 111 and outputs the detection value (light detection value). A portion of the light from the light-emitting block 111 is reflected by the optical sheet (the diffusion plate and/or reflection-type polarizing film), etc. and returned to the light-emitting block 111 side. The optical sensor 113 detects, for example, synthesized light made up of light that is directly incident from the light-emitting block 111 (direct light) and light that is reflected by the optical sheet 106 and returned to the LED substrate 101 side (reflected light). It is possible to use a brightness sensor (photodiode, phototransistor, etc.) which detects the brightness of the light, as the optical sensor 113. Furthermore, it is also possible to use as the optical sensor 113 a color sensor which detects the color of the light. It is also possible to use an optical sensor which detects both the brightness and the color of the light, as the optical sensor 113. From the detection value of the optical sensor 113, it is possible determine change in at least one of the light emission color and the light emission brightness of the light-emitting block 111 due to deterioration of the LEDs 112 and/or temperature variations.

There are no particular restrictions on the number, shape and arrangement of the light-emitting blocks 111. One light-emitting block may be used as the LED substrate 101. For instance, on the LED substrate 101, the abovementioned 35 light-emitting blocks 111 may be used as one light-emitting block. Furthermore, the plurality of light-emitting blocks 111 may be arranged in a staggered matrix configuration. In the example in FIG. 2, the shape of the light-emitting blocks 111 in a case where the light-emitting blocks 111 are viewed from the front surface direction is a square shape, but the light-emitting block 111 may also have a triangular, pentagonal, hexagonal or circular shape, etc.

Similarly, there are no particular restrictions on the number, shape and arrangement of the partial regions. For example, a plurality of split regions configuring the region of the screen may be used as a plurality of partial regions. The plurality of partial regions may be separated from each other, at least a portion of one partial region may overlap with at least a portion of another partial region.

Similarly, there are no particular restrictions on the number and arrangement of the LEDs 112. Furthermore, there are no particular restrictions on the type (light emission color) of the LEDs 112. For example, LEDs which emit yellow light may be used. It is also possible to omit at least one of R-LEDs and B-LEDs.

Similarly, there are no particular restrictions on the number and arrangement of the optical sensors 113. For example, it is also possible to provide one optical sensor 113 for two or more light-emitting blocks 111.

FIG. 3 is a schematic drawing showing one example of the arrangement of a plurality of light-emitting blocks 111 in a case where the plurality of light-emitting blocks 111 are viewed from the front surface direction. In the present embodiment, as shown in FIG. 3, the light-emitting block 111 arranged in the Xth row and the Yth column (X=1-5 and Y=1-7) is termed "light-emitting block 111(X,Y)". For example, the light-emitting block 111 disposed in the upper left corner is termed "light-emitting block 111 (1,1)" and the light-emitting block 111 disposed in the lower right corner is termed "light-emitting block 111 (5,7)".

Figure 4:
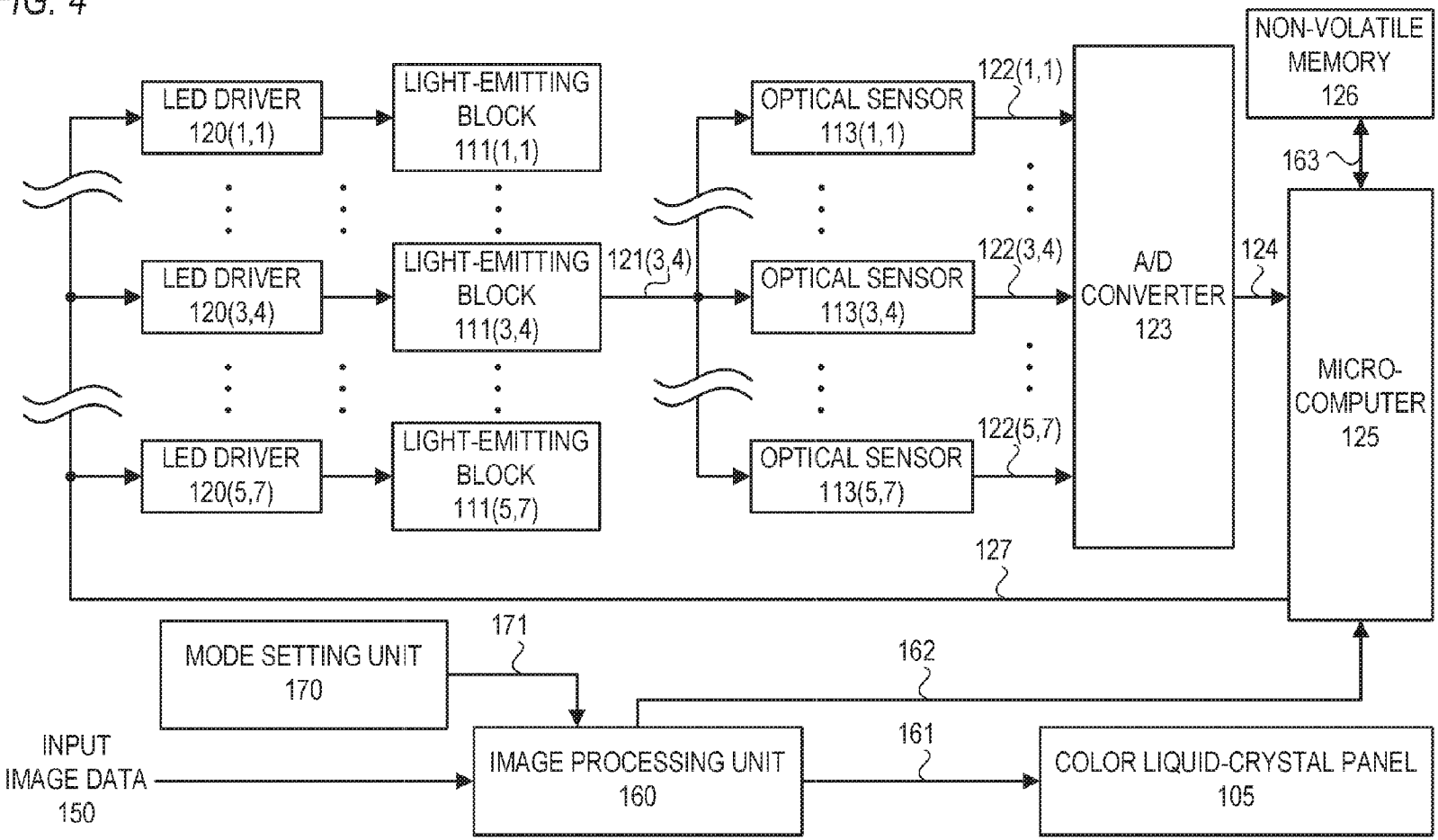
FIG. 4 shows one example of the configuration of a color image display apparatus relating to the first embodiment.

FIG. 4 is a block diagram showing one example of the configuration of a color image display apparatus relating to the present embodiment. Firstly, one example of the operation of the color image display apparatus in a case of displaying an image based on input image data will be described.

The mode setting unit 170 sets the image processing unit 160 to anyone of a plurality of drive modes, each having mutually different methods for driving the LED substrate 101 (plurality of LEDs 112). More specifically, the mode setting unit 170 outputs a mode signal 171 indicating any one of the plurality of drive modes, to the image processing unit 160. Consequently, the drive mode indicated by the mode signal 171 is set in the image processing unit 160. In the present embodiment, the plurality of drive modes include an LD mode (first mode) and a non-LD mode (second mode). The LD mode is a drive mode which adaptively changes at least one of the light emission brightness and the light emission color of the LED substrate 101. Furthermore, the LD mode is a drive mode which changes at least one of the light emission brightness and the light emission color of the LED substrate 101, individually, in each of the plurality of partial regions (execution of local dimming control). In other words, the LD mode is a drive mode which individually changes at least one of the light emission brightness and the light emission color of the plurality of light-emitting blocks 111. The non-LD mode is a drive mode which does not change the light emission brightness or the light emission color of the LED substrate 101. Furthermore, the non-LD mode is a drive mode which causes the light emission brightness and the light emission color of the LED substrate 101 to coincide substantially (or completely) between the plurality of partial regions. In other words, the non-LD mode is a drive mode which causes the light emission brightness and the light emission color of the light-emitting blocks 111 to coincide substantially in each of the plurality of light-emitting blocks 111 (local dimming control not executed).

The image processing unit 160 carries out processing corresponding to the set drive mode.

Firstly, a case where the non-LD mode is set will be described. In this case, the image processing unit 160 determines a common LD correction value 162 for each of the plurality of the light-emitting blocks 111, and the determined LD correction value 162 is output to a microcomputer 125. The LD correction value 162 is determined for each light emission color of the LED 112. Furthermore, the image processing unit 160 generates display image data 161 by applying predetermined image processing to the input image data 150. The predetermined image processing involves general image processing, for example, resolution conversion processing, sharpness processing, color conversion processing, gamma conversion, and the like. The image processing unit 160 outputs the generated display image data 161 to the color liquid-crystal panel 105. The input image data may be used as display image data.

Next, a case where the LD mode is set will be described. In this case, the image processing unit 160 determines an LD correction value 162 individually for each of the plurality of the light-emitting blocks 111, and the determined LD correction values 162 are output to a microcomputer 125. The LD correction values 162 are determined for each combination of the light-emitting block 111 and light emission color of the LEDs 112. Furthermore, the image processing unit 160 generates display image data 161 by applying non-uniformity reduction processing and the abovementioned predetermined image processing to the input image data 150. In a case where local dimming control is implemented to change the light emission of the plurality of light-emitting blocks 111, individually, unwanted non-uniformity (brightness non-uniformity (halo effect) and/or color non-uniformity) may occur in the display image (the image display on the screen), due to differences in the light emission between the plurality of light-emitting blocks 111. The non-uniformity reduction processing is image processing for reducing the non-uniformities of this kind. The image processing unit 160 outputs the generated display image data to the color liquid-crystal panel 105. The predetermined image processing described above does not have to be carried out.

A concrete example of the determination method of the LD correction value 162 in a case where the LD mode has been set will now be described. The image processing unit 160 determines the brightness of the image data that is to be displayed on the partial region, by analyzing the input image data 150, for each of the plurality of partial regions. For each of the plurality of partial regions, the image processing unit 160 determines the LD correction value 162 for the light-emitting block 111 corresponding to that partial region, in accordance with the brightness of the image data that is to be displayed in that partial region. For example, the LD correction value 162 is determined in such a manner that the light emission brightness of a light-emitting block 111 where the brightness of the image data to be displayed in the partial region is low is controlled to a higher value than the light emission brightness of a light-emitting block 111 where the brightness of the image data to be displayed in the partial region is high.

Light emission change correction values 163 determined for each of the plurality of light-emitting blocks 111 are recorded in a non-volatile memory 126. The light emission change correction values 163 are determined for each combination of the light-emitting block 111 and light emission color of the LEDs 112. The microcomputer 125 reads out the light emission change correction values 163 determined for each of the plurality of the light-emitting blocks 111, from the non-volatile memory 126. The microcomputer 125 generates an LED driver control signal 127 for each of the plurality of light-emitting blocks 111, on the basis of the LD correction values 162 output from the image processing unit 160 and the light emission change correction values 163 which have been read out. Subsequently, the microcomputer 125 outputs the LED driver control signal 127 generated for the light-emitting block 111, to the LED driver 120 corresponding to that light-emitting block 111. In FIG. 4, the LED driver 120 corresponding to the light-emitting block 111(X, Y) is termed "LED driver 120(X,Y)". The LED driver 120(X,Y) drives the light-emitting block 111(X,Y) in accordance with the input LED driver control signal 127. As a result of this, the LED substrate 101 is driven by a drive method corresponding to the drive mode set by the mode setting unit 170.

Next, one example of the operation of the color image display apparatus in a case of generating the light emission change correction values 163 is described. If there is change in the temperature and deterioration over time of the plurality of LEDs 112, the light emission characteristics of the plurality of LEDs 112 change. As a result of this, unwanted change in the light emission brightness and/or light emission color of the LED substrate 101 occurs. Furthermore, in a case where there is fluctuation in the temperature and deterioration over time of the plurality of LEDs 112, the light emission characteristics of the plurality of LEDs 112 also fluctuate. As a result of this, light having unwanted non-uniformity (brightness non-uniformity and/or color non-uniformity) is emitted from the LED substrate 101. The light emission change correction value 163 is a correction value for reducing the unwanted variation and/or non-uniformity in the light emitted from the LED substrate 101. In the present embodiment, the following processing (processing for generating light emission change correction values 163; light emission adjustment processing) is carried out periodically or at specific timings. The light emission adjustment process may be carried out during free time when the user is not using the color image display apparatus, but does not necessarily have to be carried out in this way. The adjustment process may also be carried out in a short period of time such that variation in the quality of the display image due to the execution of light emission adjustment processing is not noticeable to the user while the user is using the color image display apparatus.

In the light emission adjustment process, only the light-emitting block 111 that is the object of processing (object block) is lit, and the other light-emitting blocks 111 are extinguished. In this state, the light emitted from the object block is detected using the optical sensor 113. Then, a light emission change correction value 163 is determined on the basis of the detection value of the optical sensor 113, and the light emission brightness and light emission color of the object block are adjusted using the determined light emission change correction value 163. Furthermore, the determined light emission change correction value 163 is recorded in the non-volatile memory 126. Processing of this kind is carried out respectively for each of the plurality of light-emitting blocks 111. Below, an example where the light-emitting block 111(3,4) is the object block is described. Furthermore, below, an example where the light emission brightness of the light-emitting block 111 is adjusted is described.

In the optical sensor 113, the light 121(3,4) emitted from the light-emitting block 111(3,4) is detected. The optical sensor 113 outputs an analogue value 122 (detection value) which represents the brightness, in accordance with the brightness of the detected light 121(3,4). In FIG. 4, the optical sensor 113 corresponding to the light-emitting block 111(X,Y) is termed "optical sensor 113(X,Y)", and the analogue value 122 output from the optical sensor 113(X,Y) is termed "analogue value 122(X,Y)". The A/D converter 123 selects, from among the analogue values 122 output by the optical sensors 113, the analogue value 122(3,4) output by the optical sensor 113(3,4) associated with the light-emitting block 111(3,4). The A/D converter 123 converts the selected analogue value into a digital value, and outputs the digital value 124 to the microcomputer 125. The microcomputer 125 generates (determines, calculates) the light emission change correction value 163 for the light-emitting block 111(3,4), on the basis of the detection value of the optical sensor 113(3,4). More specifically, the microcomputer 125 generates a light emission change correction value 163 for light-emitting block 111(3,4) on the basis of the digital value 124 obtained by converting the analogue value 122(3,4). The microcomputer 125 records the generated light emission change correction value 163 to the non-volatile memory 126.

The brightness reference value (reference detection value) for each light-emitting block 111 determined at the time of manufacture of the color image display apparatus is recorded previously in the non-volatile memory 126. The microcomputer 125 compares the detection value of the object block with the brightness reference value of the object block. The microcomputer 125 determines the light emission change correction value 163 of the object block in accordance with the result of the abovementioned comparison, in such a manner that the detection value of the object block matches the brightness reference value of the object block. The light emission change correction value 163 is a correction value for adjusting the LED driver control signal 127. The light emission brightness of the light-emitting block 111 can be adjusted by adjusting the pulse width or pulse amplitude of the pulse signal (current or voltage pulse signal) which is applied to the light-emitting block 111. The light emission change correction value 163 may be a correction value which modifies the pulse width, or a correction value which modifies the pulse amplitude, or a correction value which modifies both the pulse width and the pulse amplitude.

A light emission change correction value 163 which adjusts the light emission brightness of the light-emitting blocks 111 in such a manner that the detection value becomes the reference value is determined, and unwanted change and/or non-uniformity in the light emitted from the LED substrate 101 can be reduced by using the determined light emission change correction value 163.

Figure 5:
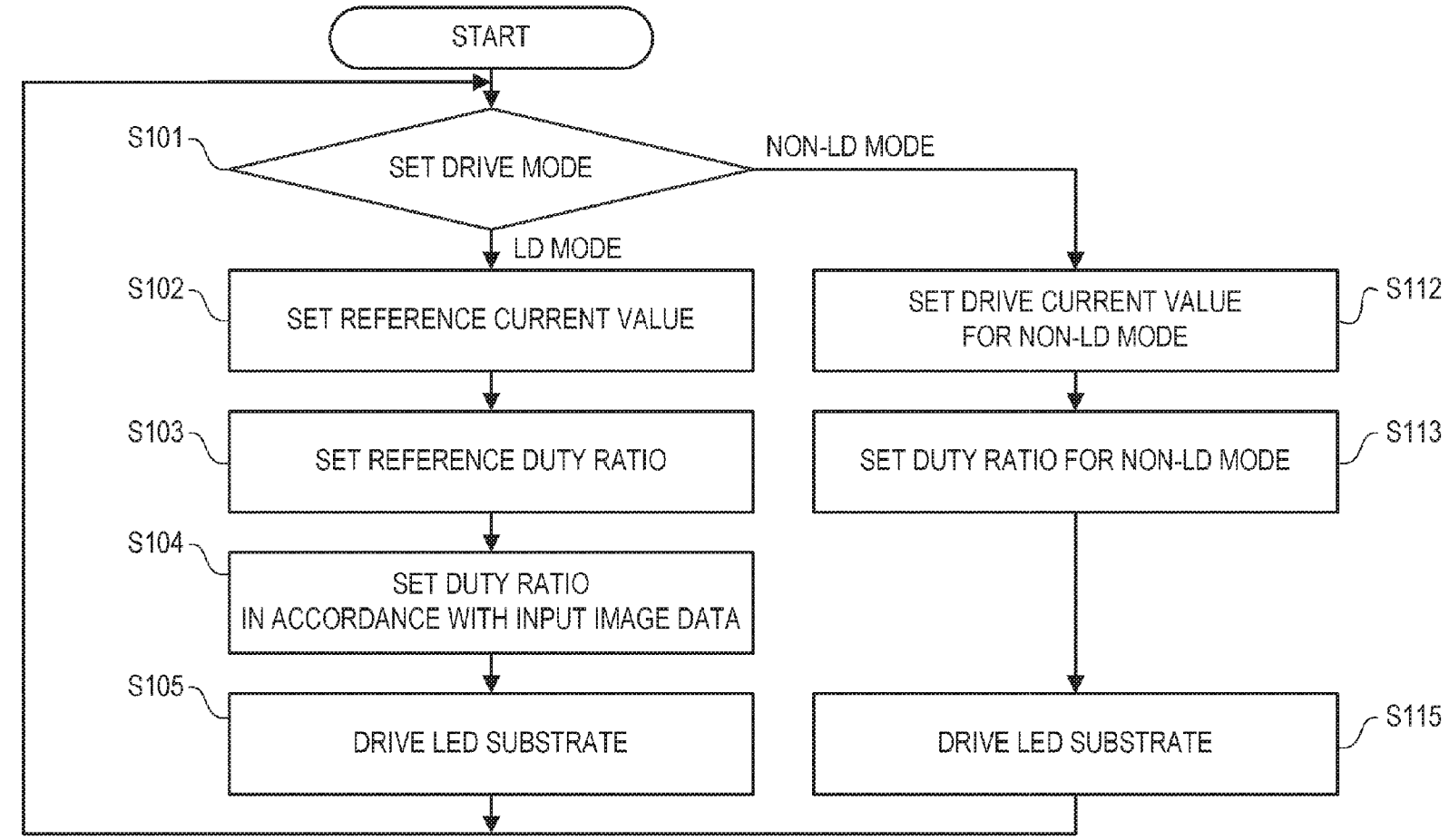
FIG. 5 shows one example of a processing flow of a color image display apparatus relating to the first embodiment.

FIG. 5 is a flowchart showing one example of a processing flow of a color image display apparatus relating to the present embodiment. Below, one example of the processing flow of a color image display apparatus relating to the present embodiment is described with reference to FIG. 5.

Firstly, the mode setting unit 170 sets a drive mode (S101). In a case where the LD mode has been set, the processing advances to S102, and in a case where the non-LD mode has been set, the processing advances to S112. The mode setting unit 170 sets the drive mode in accordance with a user operation. The user operation is a user operation for selecting one drive mode from a list of a plurality of drive modes, for example. Anon screen display (OSD) image, for example, is used for the list. There are no particular restrictions on the method for setting the drive mode. For example, the mode setting unit 170 may set (change) the drive mode automatically in accordance with the input image data 150. In a case where it is sought to raise the contrast of the display image, the LD mode is set.

In S102, the microcomputer 125 sets a reference current value, which is a reference for the current (drive current value) supplied to the light-emitting blocks 111 while the light-emitting blocks 111 are lit. In the present embodiment, in the LD mode, the pulse width of the pulse current supplied to the light-emitting blocks 111 is controlled in accordance with the input image data 150. Control of the pulse width is called "PWM control". Therefore, the processing in S102 is a process for determining the current to be supplied to the light-emitting blocks 111 in a case where the light-emitting blocks 111 are lit.

In the present embodiment, the light-emitting blocks 111 emit light cyclically. After S102, the microcomputer 125 sets a reference duty ratio, which is a reference value of the duty ratio that indicates the length of the lighting period of the light-emitting block 111 in one cycle of light emission by the light-emitting block 111 (S103). In the present embodiment, the duty ratio is the ratio of the length of the lighting period to the length of one cycle. The microcomputer 125, for example, determines the reference duty ratio in accordance with the reference brightness, which is the reference value of the display brightness (on-screen brightness). In the present embodiment, the reference brightness is 100 (cd/m$^2$). The display brightness is dependent on the drive current value and the duty ratio. In a case where it is sought to reduce the display brightness to ½, the duty ratio should be halved, for instance.

The reference brightness may be a predetermined fixed value, or a value that can be changed by the user. The reference brightness may also be higher or lower than 100 (cd/m$^2$). Furthermore, there are no particular restrictions on the definition of the duty ratio. For example, the ratio of the length of the extinction period to the length of one cycle may be used as the duty ratio.

Figure 6:
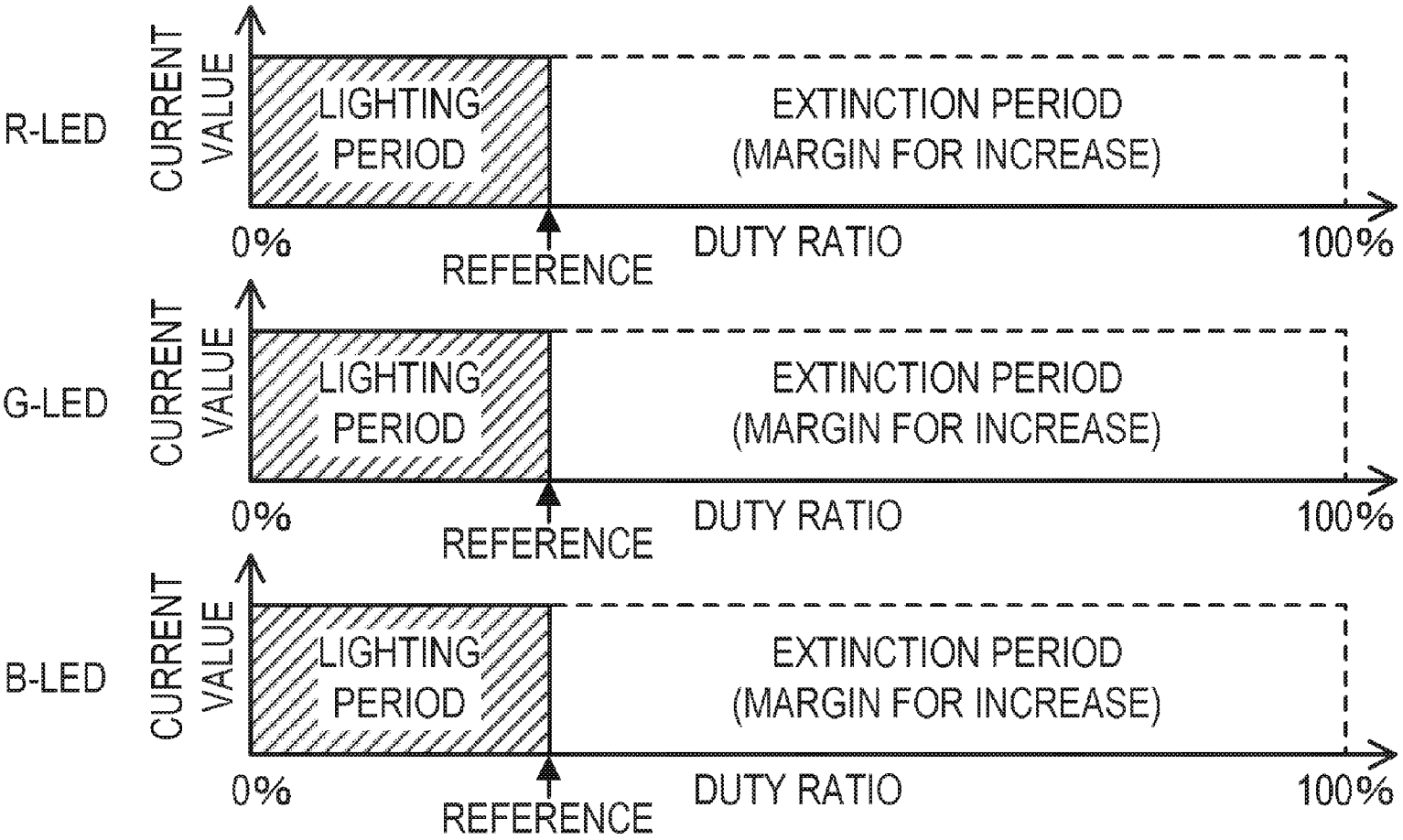
FIG. 6 shows one example of the reference current value and reference duty ratio relating to the first embodiment.

FIG. 6 is a graph showing one example of the reference current value and the reference duty ratio. In the present embodiment, each of the plurality of LEDs 112 emits light cyclically. As shown in FIG. 6, the reference current value and the reference duty ratio are set for each of the plurality of LEDs 112. The reference current value and the reference duty ratio are used, for example, in a case of displaying a white image with a reference brightness over the whole screen.

In the example in FIG. 6, the same reference current value and reference duty ratio are indicated for all of the LEDs, the R-LEDs, the G-LEDs and the B-LEDs, but the invention is not limited to this. In general, the reference current value and the reference duty ratio differ between the R-LEDs, the G-LEDs and the B-LEDs. For example, in a case where the color temperature of the light emitted from the LED substrate 101 is adjusted, the reference current value and reference duty ratio of the R-LEDs, the reference current value and reference duty ratio of the G-LEDs and the reference current value and reference duty ratio of the B-LEDs are adjusted individually. Furthermore, in general, the reference current value and the reference duty ratio are different in each of the plurality of the light-emitting blocks 111.

In the case of the LD mode, the light emission brightness and light emission color of the light-emitting blocks 111 are changed in accordance with the input image data 150. Therefore, it is necessary to provide a margin for increase in the light emission brightness of the light-emitting block 111, and the reference duty ratio is set to a low ratio. For example, the reference duty ratio is set to approximately 25% of the upper limit of the duty ratio. On the other hand, the reference current value is set to a high level in order to enable a display with the reference brightness that has been set. For example, the reference current value is set to 100 (mA) approximately. Furthermore, in a case of determining the reference current value and the reference duty ratio, the light emission change correction value 163 is used.

Figure 7:
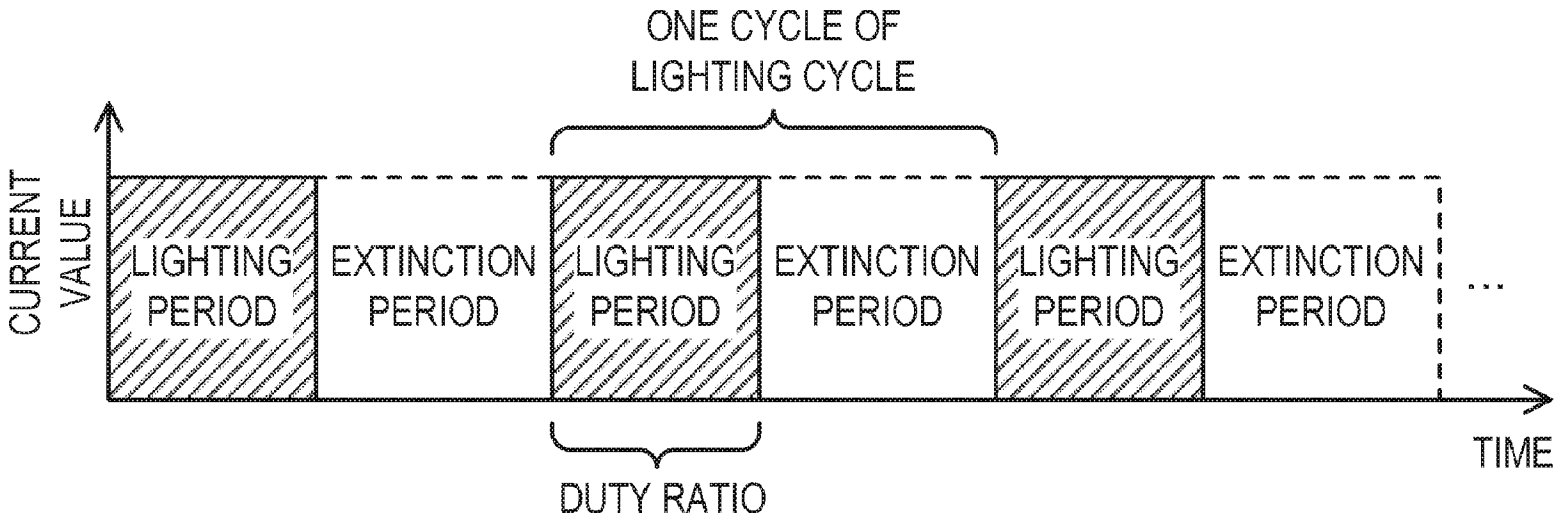
FIG. 7 shows one example of the duty ratio, drive current value and lighting cycle relating to the first embodiment.

FIG. 7 is a graph showing one example of the relationship between the duty ratio, the drive current value and the lighting cycle. Each LED 112 emits light repeatedly at a lighting cycle of approximately 48 to 600 Hz, for example. In a case where the frequency of the lighting cycle is 600 Hz, the length of one cycle of light emission in each LED 112 is approximately 1.67 ms. If the duty ratio is 25%, the length of the lighting period of the LED 112 in one cycle is approximately 0.42 ms.

The description now returns to FIG. 5. After S103, the microcomputer 125 sets the duty ratio in each light-emitting block 111, in accordance with the input image data 150 (S104). More specifically, the duty ratio of the light-emitting blocks 111 is determined by adjusting the reference duty ratio using the LED correction values 162 output from the image processing unit 160. The microcomputer 125 drives the LED substrate 101 in accordance with the reference current value set in S102 and the duty ratio set in S104 (S105).

Figure 8:
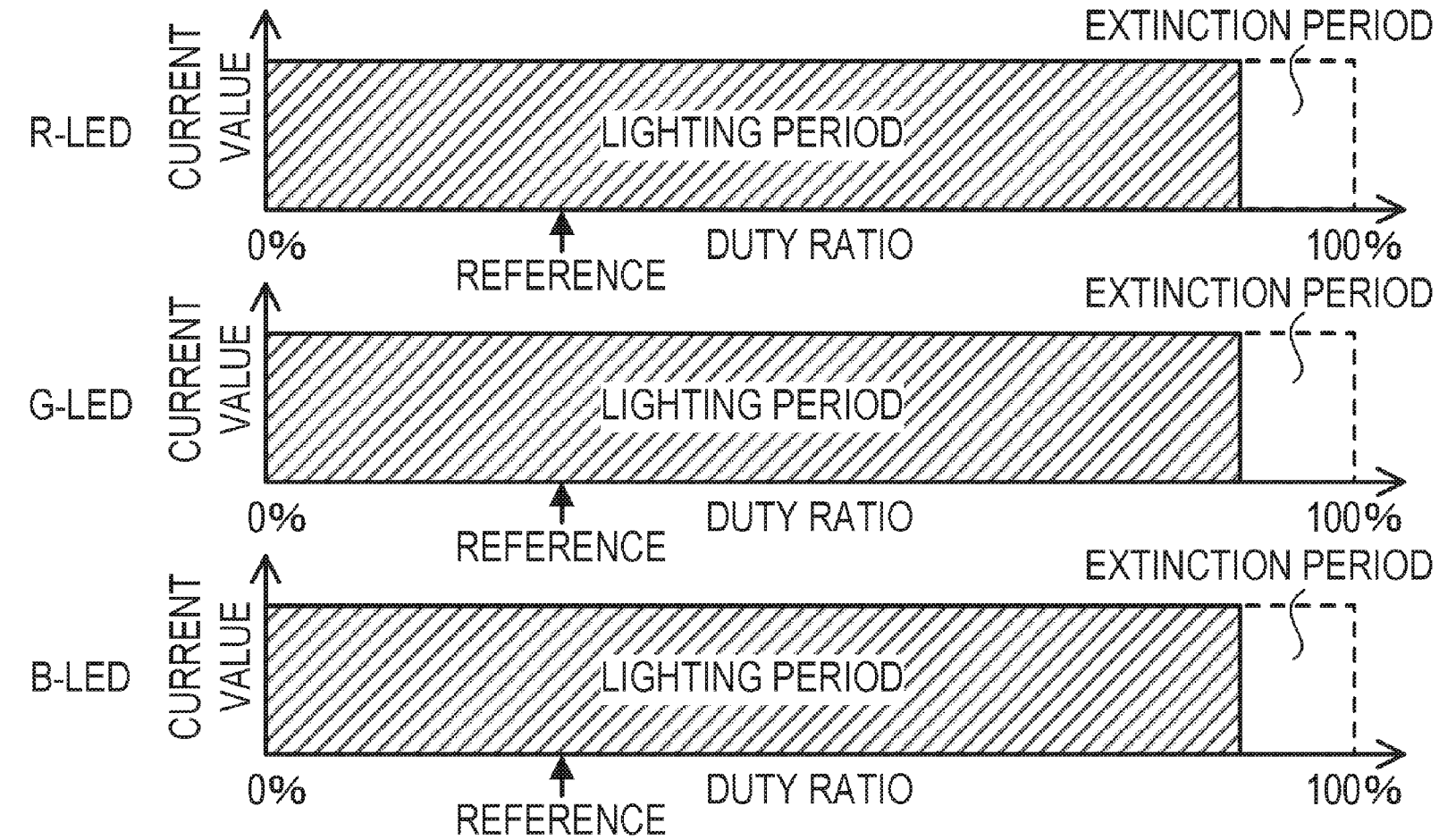
FIG. 8 shows one example of the drive current value and duty ratio relating to the first embodiment.

FIG. 8 is a graph showing one example of the duty ratio of a light-emitting block 111 in a case where the image that is to be displayed in the corresponding partial region is a bright image. In a case where the image to be displayed is bright, the duty ratio is set so that the lighting period in one cycle is longer than the reference duty ratio. In the present embodiment, the duty ratio is set to be higher than the reference duty ratio. For instance, a duty ratio of 90% is set. In a case where the reference duty ratio is 25%, a light-emitting block 111 having a duty ratio of 90% emits lights with a light emission brightness approximately 3.6 times the light emission brightness in a case where the duty ratio is the same as the reference duty ratio. A bright image region is, for example, the region of the moon in the night sky.

Figure 9:
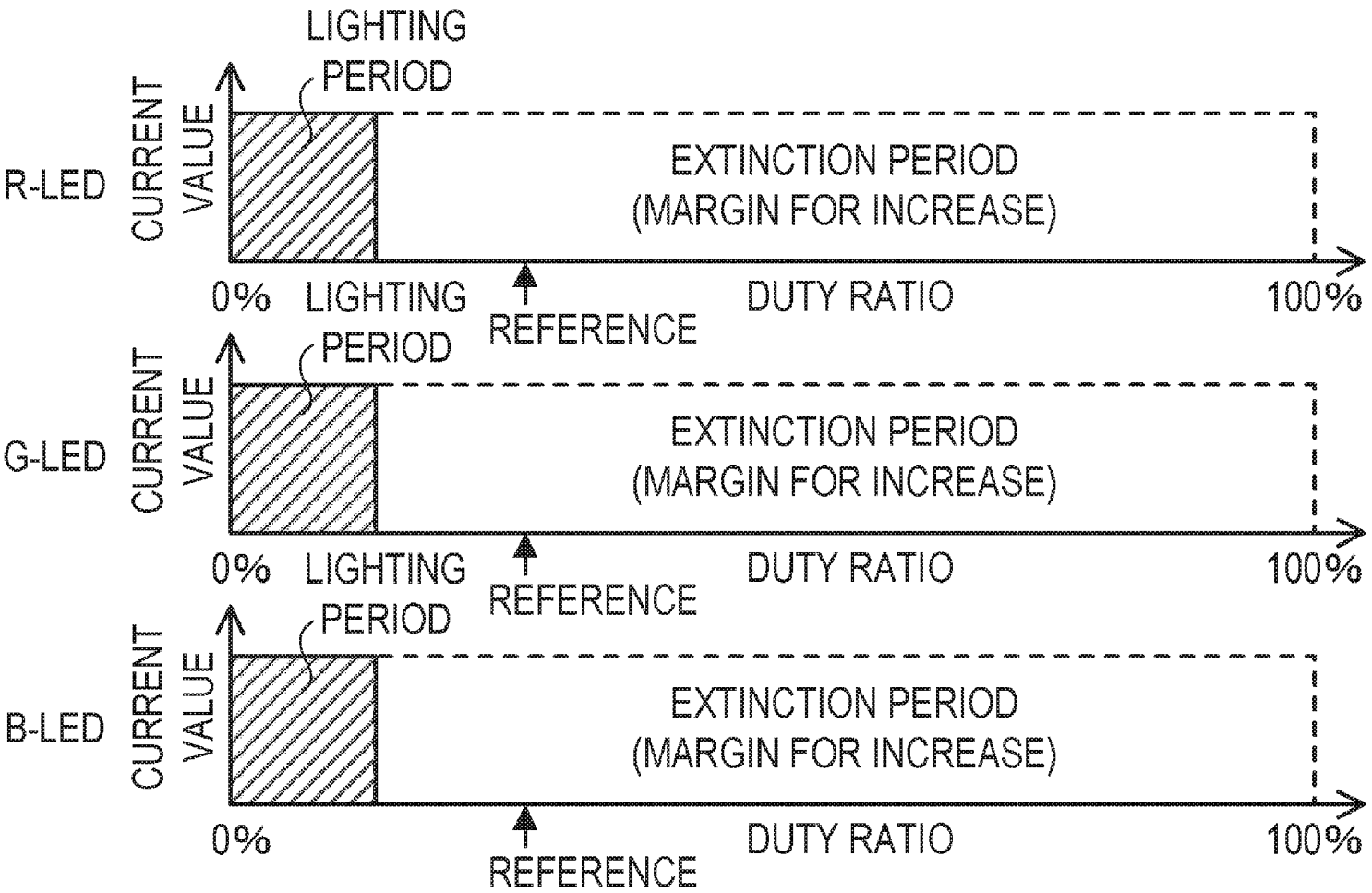
FIG. 9 shows one example of the drive current value and duty ratio relating to the first embodiment.

FIG. 9 is a graph showing one example of the duty ratio of a light-emitting block 111 in a case where the image that is to be displayed in the corresponding partial region is a dark image. In a case where the image to be displayed is dark, the duty ratio is set so that the lighting period in one cycle is shorter than the reference duty ratio. In the present embodiment, the duty ratio is set to be lower than the reference duty ratio. For instance, a duty ratio of 8% is set. In a case where the reference duty ratio is 25%, a light-emitting block 111 having a duty ratio of 8% emits lights with a light emission brightness approximately 0.3 times the light emission brightness in a case where the duty ratio is the same as the reference duty ratio. A dark image region is, for example, a night sky region which is the background of fireworks.

The processing in S104 and S105 is carried out repeatedly with each frame of the input image data 150, for instance. After S105, the processing returns to S101. The processing in S102 to S105 is carried out repeatedly while the LD mode is set, and in a case where the non-LD mode is set, the processing advances to S112.

In S112, the microcomputer 125 sets the drive current value for non-LD mode. Next, the microcomputer 125 sets the duty ratio for non-LD mode (S113). In S112 and S113, the drive current value and duty ratio are set for each of the plurality of LEDs 112, similarly to S102 to S104. In S112 and S113, the drive current value and the duty ratio are set in such a manner that the light emission brightness and the light emission color of the light-emitting block 111 substantially match those in a case where the LD mode is set. Then, the microcomputer 125 drives the LED substrate 101 in accordance with the drive current value set in S112 and the duty ratio set in S113.

Figure 10:
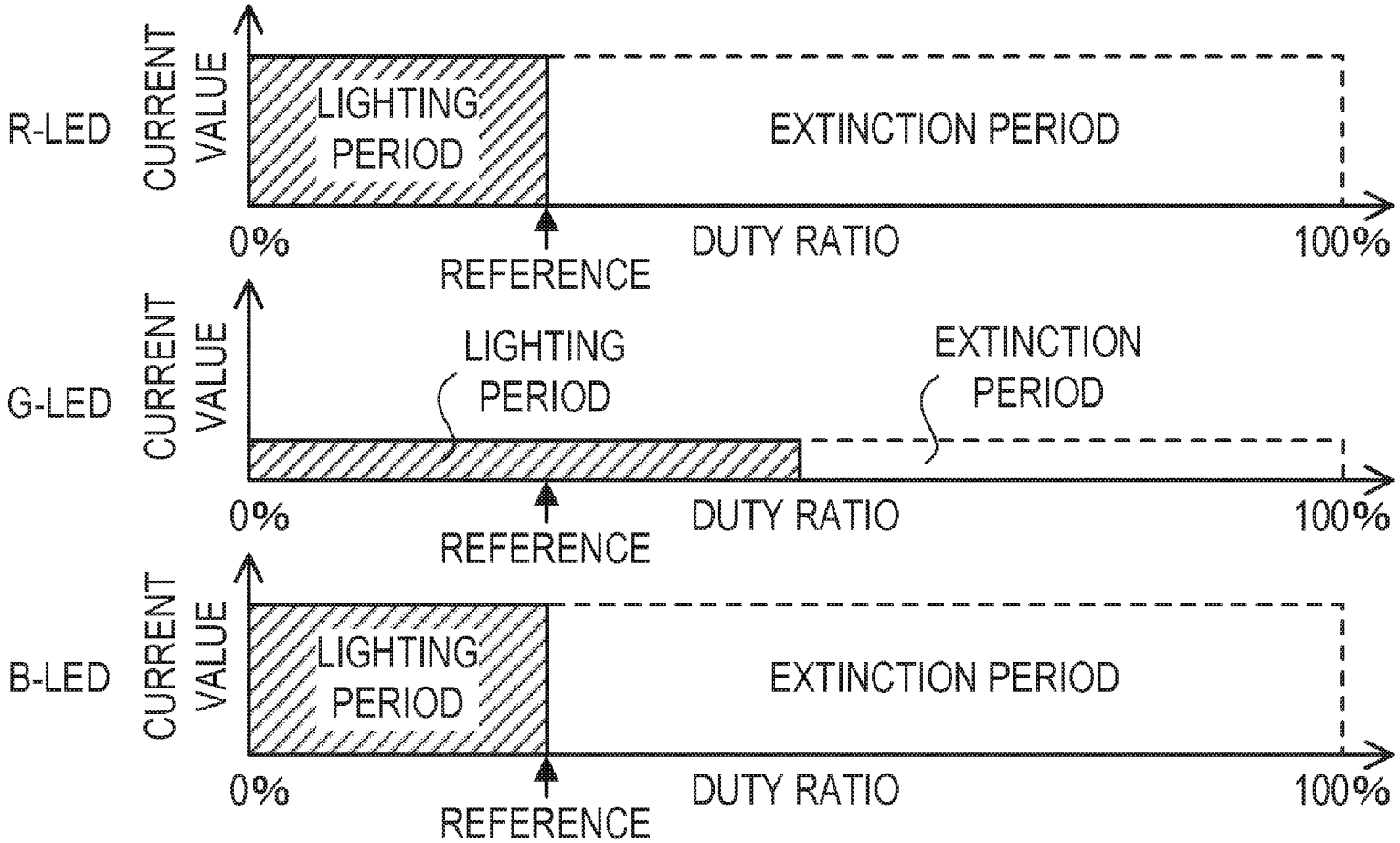
FIG. 10 shows one example of the drive current value and duty ratio relating to the first embodiment.

FIG. 10 is a graph showing one example of the drive current value and the duty ratio set in S112 and S113. As shown in FIG. 10, in the present embodiment, the drive current value of the G-LEDs is lower than the reference current value. The duty ratio of the G-LEDs is lower than the reference duty ratio. In other words, the lighting period of the G-LEDs in one cycle of light emission of the G-LEDs is longer than the reference duty ratio. More specifically, a drive current value (100 (mA)) which is the same as the reference current value, and a duty ratio (25%) which is the same as the reference duty ratio, are set for the R-LEDs and the B-LEDs. For the G-LEDs, a value of 25 (mA), which is ¼ of the reference current value, is set as the drive current value and a value of 50%, which is two times the reference duty ratio, is set as the duty ratio. The power efficiency of the G-LEDs is improved greatly by lowering the drive current value. Therefore, it is possible to reduce the power consumption of the whole apparatus, by using the values shown in FIG. 10 as the drive current value and the duty ratio of the G-LEDs. More specifically, by changing the drive current value of the G-LEDs from 100 (mA) to 25 (mA) and changing the duty ratio of the G-LEDs from 25% to 50%, it is possible to reduce the power consumption of the G-LEDs by approximately one half, while suppressing change in the light emission brightness of the G-LEDs. The drive current value of the R-LEDs and the B-LEDs may be different to the reference current value, and the duty ratio of the R-LEDs and the B-LEDs may be different to the reference duty ratio.

Below, the improvement in power efficiency achieved by carrying out the processing in S112 to S115 will be described.

Figure 11:
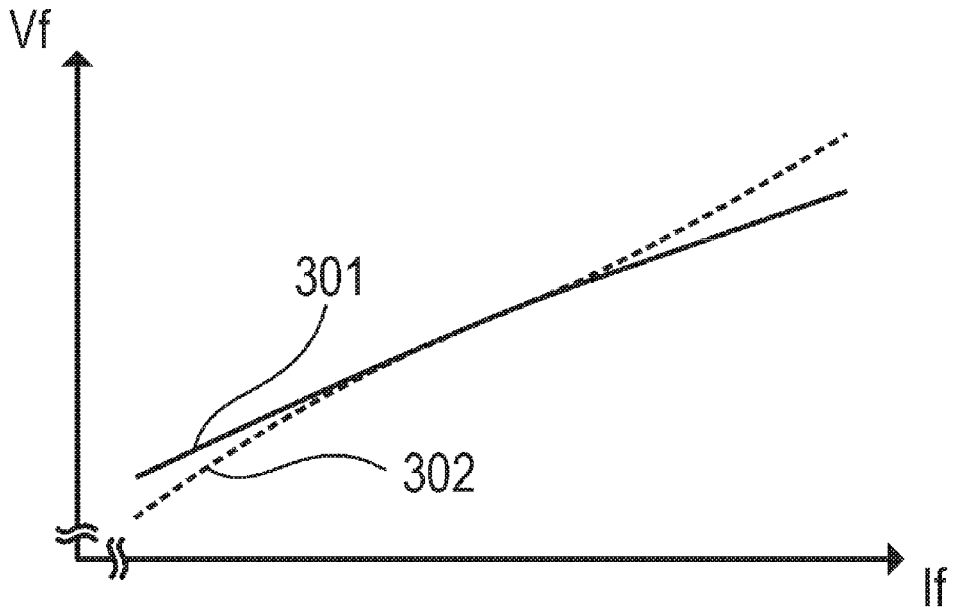
FIG. 11 shows one example of the drive current value and forward voltage relating to the first embodiment.

FIG. 11 is a graph showing one example of the relationship between the drive current value If and the forward voltage Vf in the LEDs 112. The horizontal axis in FIG. 11 indicates the drive current value If and the vertical axis in FIG. 11 indicates the forward voltage Vf. The solid line 301 indicates the characteristics of the R-LEDs and the broken line 302 indicates the characteristics of the G-LEDs and the B-LEDs.

In the R-LEDs, as shown by the solid line 301, the reduction in the forward voltage Vf due to reduction in the drive current value If is not particularly large. On the other hand, in the G-LEDs and the B-LEDs, as shown by the broken line 302, the reduction in the forward voltage Vf due to reduction in the drive current value If is large. The power consumed by the LEDs is calculated by multiplying the forward voltage Vf by the drive current value If. Therefore, in the G-LEDs and the B-LEDs, the forward voltage Vf is reduced greatly and the power consumption is reduced significantly, by the reduction in the drive current value If.

Figure 12:
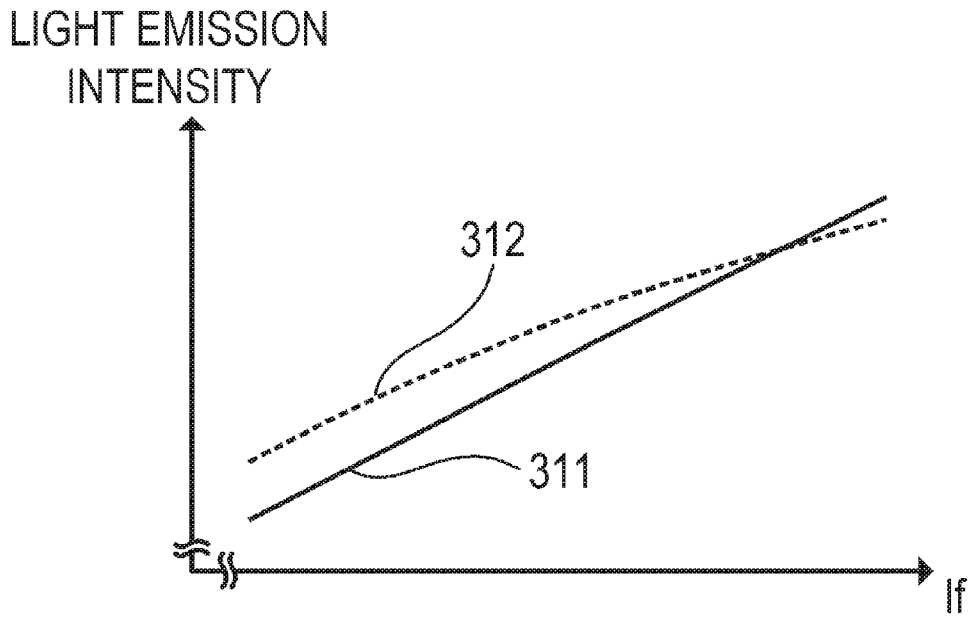
FIG. 12 shows one example of the drive current value and light emission intensity relating to the first embodiment.

FIG. 12 is a graph showing one example of the relationship between the drive current value If and the light emission intensity (momentary value of light emission brightness) in the LEDs 112. The horizontal axis in FIG. 12 indicates the drive current value If and the vertical axis in FIG. 12 indicates the light emission intensity. The solid line 311 indicates the characteristics of the R-LEDs and the B-LEDs and the broken line 312 indicates the characteristics of the G-LEDs.

In the R-LEDs and the B-LEDs, there is a large reduction in the light emission intensity due to reduction in the drive current value If. Therefore, in the R-LEDs and the B-LEDs, a long lighting period is required in order to suppress reduction in the light emission brightness due to reduction in the drive current value If. On the other hand, in the G-LEDs, the reduction of the light emission intensity due to reduction in the drive current value If is not particularly large. This is because the quantum efficiency is improved by the reduction in the drive current value If. Therefore, in the G-LEDs, it is possible to suppress reduction in the light emission brightness due to reduction in the drive current value If, without increasing the lighting period to a great extent.

Figure 13:
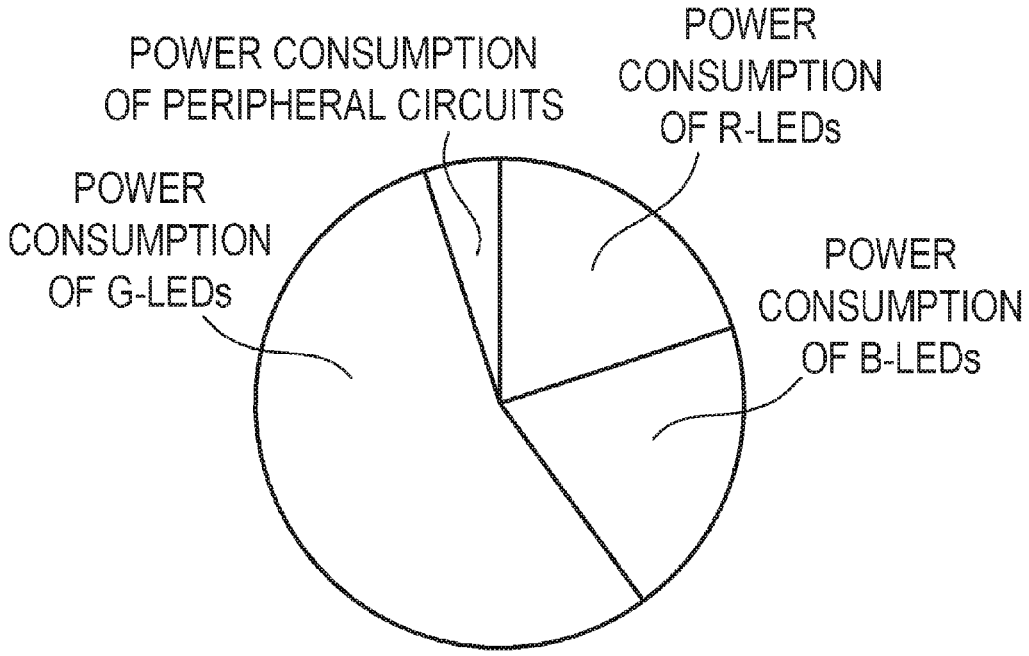
FIG. 13 shows one example of the composition of the power consumption relating to the first embodiment.

FIG. 13 is a schematic drawing showing an example of the composition of the power consumption of the LED substrate 101. FIG. 13 shows an example of a case where the light emission brightness of each LED 112 is adjusted in such a manner that white light is emitted from the LED substrate 101.

From FIG. 13, it can be seen that the power consumption of the G-LEDs is the greatest. More specifically, the ratio of the power consumption of the G-LEDs with respect to the overall power consumption is approximately 55%. This is because the light emission efficiency of the G-LEDs is lower than that of the R-LEDs and/or the B-LEDs. For example, the light emission efficiency of the G-LEDs is said to be no more than approximately one half that of the B-LEDs, which are a GaN-type semiconductors, similarly to the G-LEDs. The ratio of the power consumption of the R-LEDs and the ratio of the power consumption of the B-LEDs are each about 20%. The power consumption of the peripheral circuits apart from the LEDs is approximately 5%. Therefore, it can be seen that a large reduction in the power consumption of the G-LEDs brings a large reduction in the power consumption of the whole apparatus.

Figure 14:
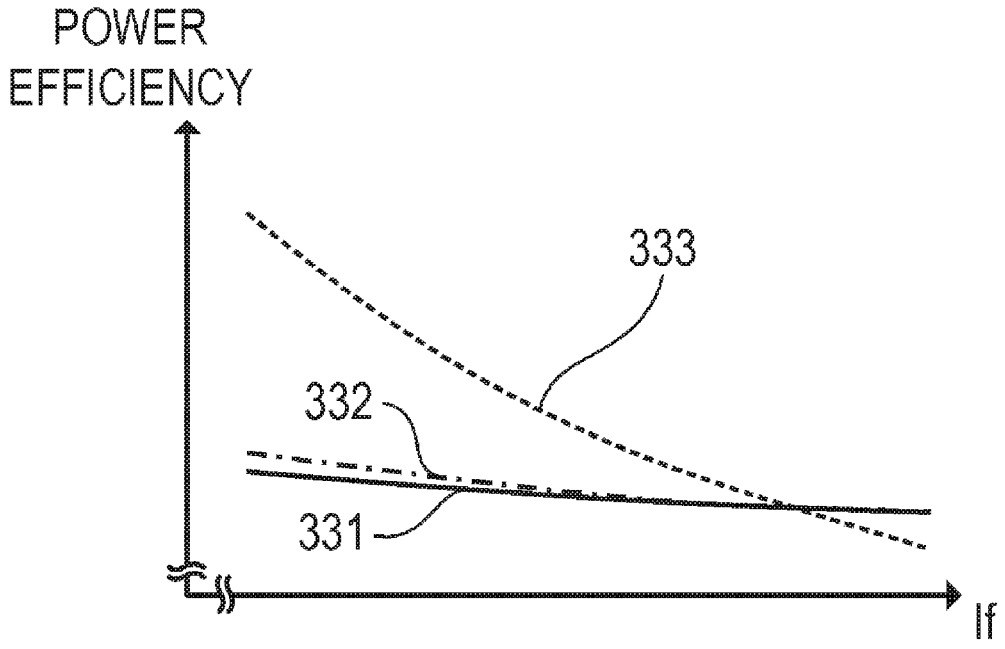
FIG. 14 shows one example of the drive current value and power efficiency relating to the first embodiment.

FIG. 14 is a graph showing one example of the relationship between the drive current value If and the power efficiency of the LED substrate 101 in the LEDs 112. The horizontal axis in FIG. 14 indicates the drive current value If and the vertical axis in FIG. 14 indicates the power efficiency. The characteristics shown in FIG. 14 are determined on the basis of the characteristics shown in FIGS. 11 to 13. The power efficiency in FIG. 14 is the power efficiency of the whole LED substrate 101 and means the light emission brightness per unit power.

The solid line 331 shows the characteristics of the R-LEDs. As shown in FIGS. 11 and 12, in the R-LEDs, there is little reduction in the forward voltage Vf due to reduction in the drive current value If, and there is a large reduction in the light emission intensity due to reduction in the drive current value If. Furthermore, as shown in FIG. 13, the ratio of the power consumption of the R-LEDs with respect to the power consumption of the LED substrate 101 as a whole is small. From the foregoing, as indicated by the solid line 331, the increase in the power efficiency due to reduction in the drive current value If is extremely small.

The single-dotted line 332 shows the characteristics of the B-LEDs. As shown in FIG. 11, in the B-LEDs, there is a large reduction in the forward voltage Vf due to reduction in the drive current value If. However, as shown in FIG. 12, there is a large reduction in the light emission intensity due to reduction in the drive current value If. Furthermore, as shown in FIG. 13, the ratio of the power consumption of the B-LEDs with respect to the power consumption of the LED substrate 101 as a whole is small. From the foregoing, as indicated by the single-dotted line 332, the increase in the power efficiency due to reduction in the drive current value If is small.

The broken line 333 shows the characteristics of the G-LEDs. As shown in FIGS. 11 and 12, in the G-LEDs, there is a large reduction in the forward voltage Vf due to reduction in the drive current value If, and there is a small reduction in the light emission intensity due to reduction in the drive current value If. Furthermore, as shown in FIG. 13, the ratio of the power consumption of the G-LEDs with respect to the power consumption of the LED substrate 101 as a whole is large. From the foregoing, as indicated by the broken line 333, the increase in the power efficiency due to reduction in the drive current value If is extremely large.

From the above, as shown in FIG. 10, it is possible to reduce the power consumption of the whole apparatus by reducing the drive current value of the G-LEDs and raising the duty ratio of the G-LEDs. In the present embodiment, as shown in FIG. 10, similar processing to that for the G-LEDs is not carried out in respect of the B-LEDs. This is because the increase in power efficiency obtained by the process of reducing the current value of the B-LEDs and raising the duty ratio of the B-LEDs is outweighed by the increase in deterioration over time of the B-LEDs resulting from that process.

Figure 15:
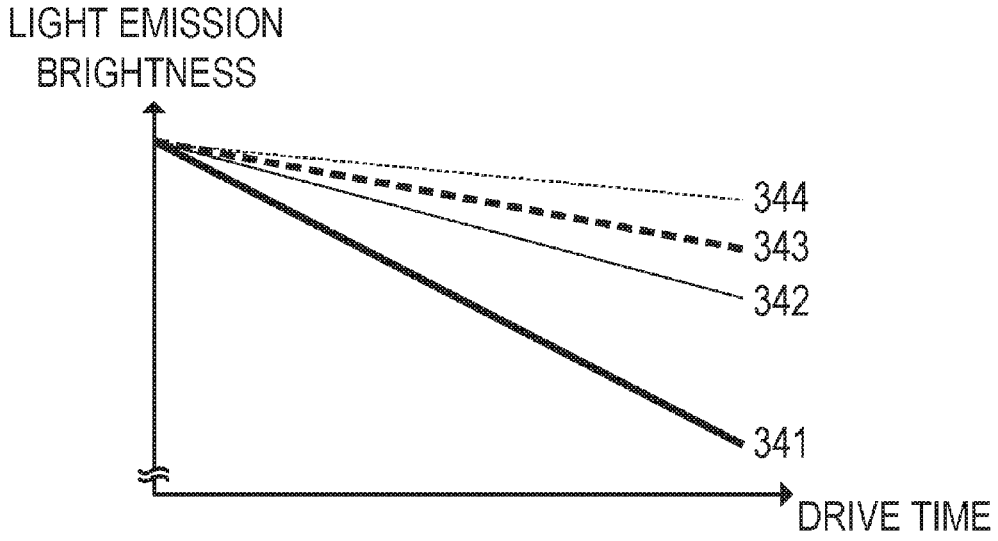
FIG. 15 shows one example of deterioration over time relating to the first embodiment.

FIG. 15 is a graph showing one example of the relationship (deterioration over time) between the drive time of an LED 112 and the light emission brightness thereof. The horizontal axis in FIG. 15 indicates the drive time of the LED 112 and the vertical axis in FIG. 15 indicates the light emission brightness of the LED 112. The light emission brightness shown in FIG. 15 is a value normalized by the light emission brightness in a case where the drive time is zero.

The reduction in the light emission brightness of the LED that occurs with the passage of time is largely dependent on the light emission color and/or use conditions of the LED. The thick solid line 341 in FIG. 15 indicates the deterioration over time of a B-LED in a case where the B-LED is used continuously with a drive current value of 50 (mA) and a duty ratio of 50%. The thin solid line 342 indicates the deterioration over time of the B-LED in a case where the B-LED is used continuously with a drive current value of 100 (mA) and a duty ratio of 25%. The thick broken line 343 indicates the deterioration over time of a G-LED in a case where the G-LED is used continuously with a drive current value of 50 (mA) and a duty ratio of 50%. The thin broken line 344 indicates the deterioration over time of the G-LED in a case where the G-LED is used continuously with a drive current value of 100 (mA) and a duty ratio of 25%.

The deterioration over time of an LED is dependent on the light emission wavelength (the wavelength of the light emitted by the LED), the duty ratio and the chip temperature (LED temperature). The shorter the light emission wavelength, the faster the deterioration over time. The higher the duty ratio, the faster the deterioration over time. The higher the chip temperature, the faster the deterioration over time. Since the light emission wavelength of the B-LEDs is short, the rate of deterioration over time is extremely fast, as indicated by the thick solid line 341, and the thin solid line 342. Furthermore, the deterioration over time is accelerated by the process of reducing the drive current value and raising the duty ratio. From these factors, it can be seen that in a case where a process is carried out to reduce the drive current value of the B-LEDs and also raise the duty ratio of the B-LEDs, the resulting acceleration of the deterioration over time of the B-LEDs is greater than the effect in improving the power efficiency. The light emission wavelength of the G-LEDs is longer than that of the B-LEDs, and therefore the deterioration over time is relatively slower, as indicated by the thick broken line 343 and the thin broken line 344. There is a possibility that the deterioration over time of the G-LEDs will be accelerated by a process of reducing the drive current value of the G-LEDs and raising the duty ratio of the G-LEDs. However, the power efficiency is improved significantly by a process of this kind. As a result of this, reduction in the temperature of the G-LEDs can be expected and there are few concerns over accelerating the deterioration over time of the G-LEDs.

As described above, according to the present embodiment, based on the following assumption, the drive current value of the G-LEDs is lower and the lighting period of the G-LEDs is longer in the second mode (non-LD mode) than in the first mode (LD mode). Therefore, it is possible to reduce the power consumption of the light source apparatus, without carrying out local dimming control. The circumstances of the following assumption are, for example, that "the G-LEDs are driven with the reference current value and reference duty ratio shown in FIG. 6 in a case where the first mode is set, and the G-LEDs are driven as the drive current value and duty ratio shown in FIG. 10, in a case where the second mode is set". In the present embodiment, in a case where the following assumption (first assumption) is established, the assumption "the LED substrate 101 is driven in such a manner that the light emission brightness and the light emission color of the LED substrate 101 substantially coincide between the first mode and the second mode" (second assumption) is also established. However, the second assumption does not have to be established in a case where the first assumption is established.

Assumption: The G-LEDs are driven in such a manner that the light emission brightness of the G-LEDs substantially coincides between the first mode and the second mode.

In the present embodiment, an example was described in which the first mode is the LD mode, but the invention is not limited to this. For example, the first mode may be a drive mode which always uses the reference current value and the reference duty ratio in FIG. 6. Furthermore, in the local dimming control, the drive current value may be changed in accordance with the input image data, or the drive current value and the duty ratio may be changed in accordance with the input image data.

Second Embodiment

Below, a light source apparatus, a display apparatus and a control method for same relating to a second embodiment of the present invention will be described. In the first embodiment, the first mode was LD mode and the second mode was non-LD mode. In the present embodiment, a case is described in which the first mode is non-boost mode and the second mode is boost mode. The non-boost mode according to the present embodiment is the same as the LD mode of the first embodiment. The boost mode is a drive mode which causes the LED substrate 101 to emit light with a light emission brightness that is higher than the upper limit of the light emission brightness of the LED substrate 101 in a case where the non-boost mode is set. By setting the boost mode, it is possible to improve the display brightness. In a case where the display brightness is improved, the visibility of the display image is improved in bright environments (such as a sunlit living room, or outdoors, etc.). Furthermore, by setting the boost mode, the number of identifiable gradations is increased, and therefore the boost mode is desirable in medical applications, such as mammography. Below, the functions and/or processing which are different to the first embodiment are described in detail, and the functions and/or processing which are the same as the first embodiment are not described.

A drive mode which does not change the light emission brightness or the light emission color of the LED substrate 101 may also be used as the non-boost mode. In this case, the boost mode can be regarded as a drive mode which causes the LED substrate 101 to emit light with a light emission brightness that is higher than the light emission brightness of the LED substrate 101 in a case where the non-boost mode is set.

Figure 16:
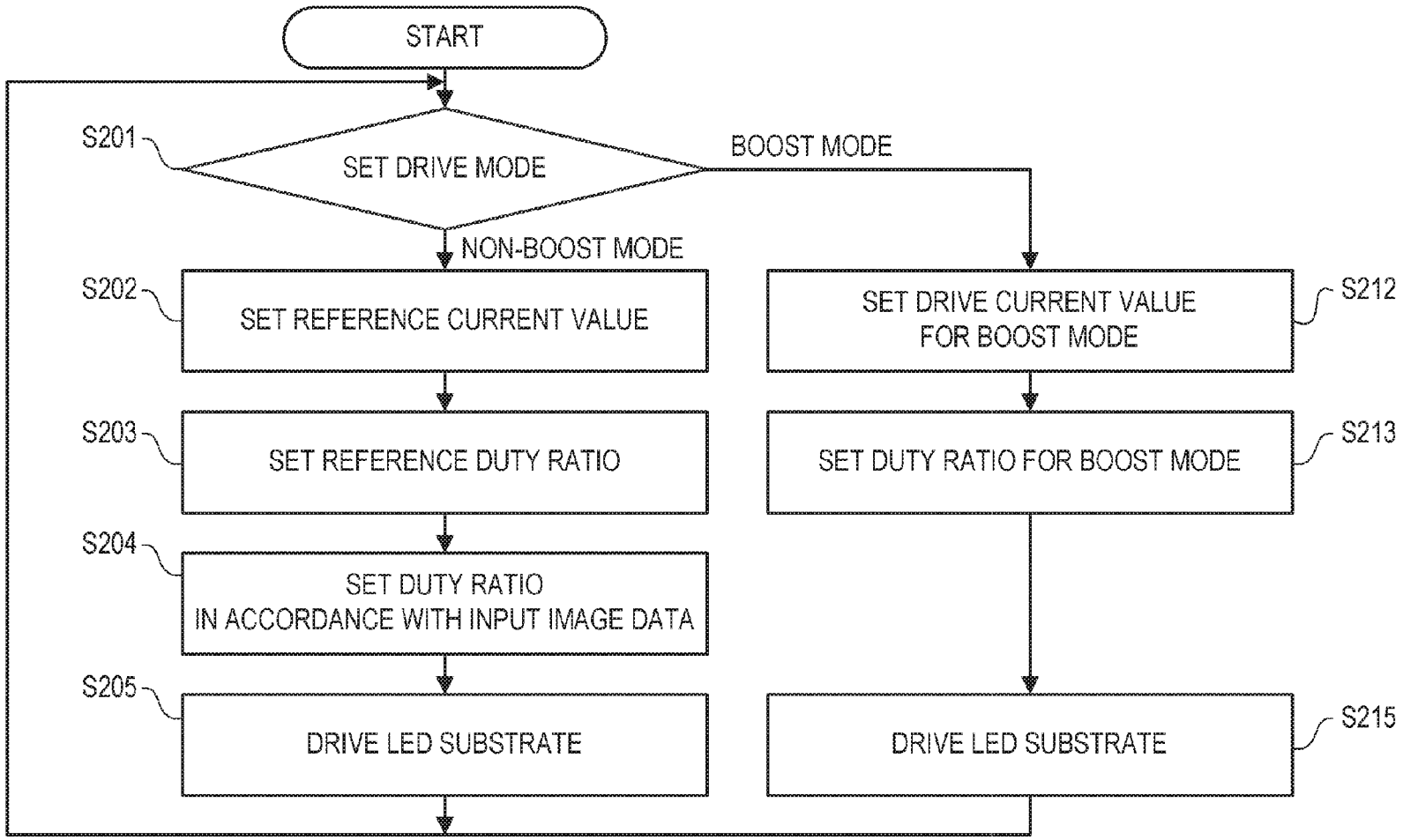
FIG. 16 shows one example of a processing flow of a color image display apparatus relating to a second embodiment.

FIG. 16 is a flowchart showing one example of a processing flow of a color image display apparatus relating to the present embodiment. Below, one example of the processing flow of a color image display apparatus relating to the present embodiment is described with reference to FIG. 16.

Firstly, the mode setting unit 170 sets the drive mode (S201). In a case where the non-boost mode has been set, the processing advances to S202, and in a case where the boost mode has been set, the processing advances to S212. The mode setting unit 170 sets the drive mode in accordance with a user operation. The user operation is a user operation for selecting one drive mode from a list of a plurality of drive modes, for example. There are no particular restrictions on the method for setting the drive mode. For example, the mode setting unit 170 may set the drive mode in accordance with a user operation other than a user operation for selecting one of a plurality of drive modes. More specifically, the mode setting unit 170 may switch the drive mode between non-boost mode and boost mode depending on whether or not the reference brightness input by the user is equal to or greater than a threshold value (for example, 100 (cd/m$^2$)). In a case where it is required to raise the upper limit value of the light emission brightness of the LED substrate 101 and/or the upper limit value of the display brightness, the boost mode is set.

There are no particular restrictions on the light emission brightness of the LED substrate 101 in a case where the non-boost mode is set and the light emission brightness of the LED substrate 101 in a case where the boost mode is set. For example, the upper limit of the light emission brightness of the LED substrate 101 in a case where the non-boost mode is set is 100 (cd/m$^2$), and the light emission brightness of the LED substrate 101 in a case where the boost mode is set is twice that (200 (cd/m$^2$)). The (upper limit) of the light emission brightness of the LED substrate 101 in each of the drive modes may be a predetermined fixed value, or may be a value that can be changed by the user.

In S202 to S205, the same processing as S102 to S105 of the first embodiment (FIG. 5) is carried out.

In S212, the microcomputer 125 sets the drive current value for boost mode. Next, the microcomputer 125 sets the duty ratio for boost mode (S213). In the present embodiment, the drive current value and the duty ratio for boost mode are set from a similar perspective to the first embodiment. In the present embodiment, at least one of the drive current value and the duty ratio is set to a value higher than FIG. 10, in such a manner that the LED substrate 101 emits light with a higher light emission brightness than in the non-LD mode in the first embodiment. The microcomputer 125 drives the LED substrate 101 in accordance with the drive current value set in S212 and the duty ratio set in S213 (S215).

As described above, according to the present embodiment, similarly to the first embodiment, based on the assumption described in the first embodiment, the drive current value of the G-LEDs is lower and the lighting period of the G-LEDs is longer in the second mode (boost mode) than in the first mode (non-boost mode). Therefore, it is possible to reduce the power consumption of the light source apparatus, without carrying out local dimming control.

Third Embodiment

Below, a light source apparatus, a display apparatus and a control method for same relating to a third embodiment of the present invention will be described. In the first and second embodiments, an example is described in which the power consumption of the whole apparatus is reduced by modifying the drive current value and duty ratio of the G-LEDs. However, the light emission wavelength (main wavelength d) of an LED changes with the drive current value of the LED. Consequently, in the first embodiment in which the balance of the drive current value is changed between the G-LEDs and the other LEDs, a change in the light emission color of the LED substrate 101 (color deviation) occurs. In the present embodiment, an example is described in which color deviation of this kind can be reduced. Below, the functions and/or processing which are different to the first embodiment are described in detail, and the functions and/or processing that are the same as the first embodiment are not described. Below, the first embodiment is described as a basis, but the processing in the present embodiment can also be applied to the second embodiment.

Figure 17:
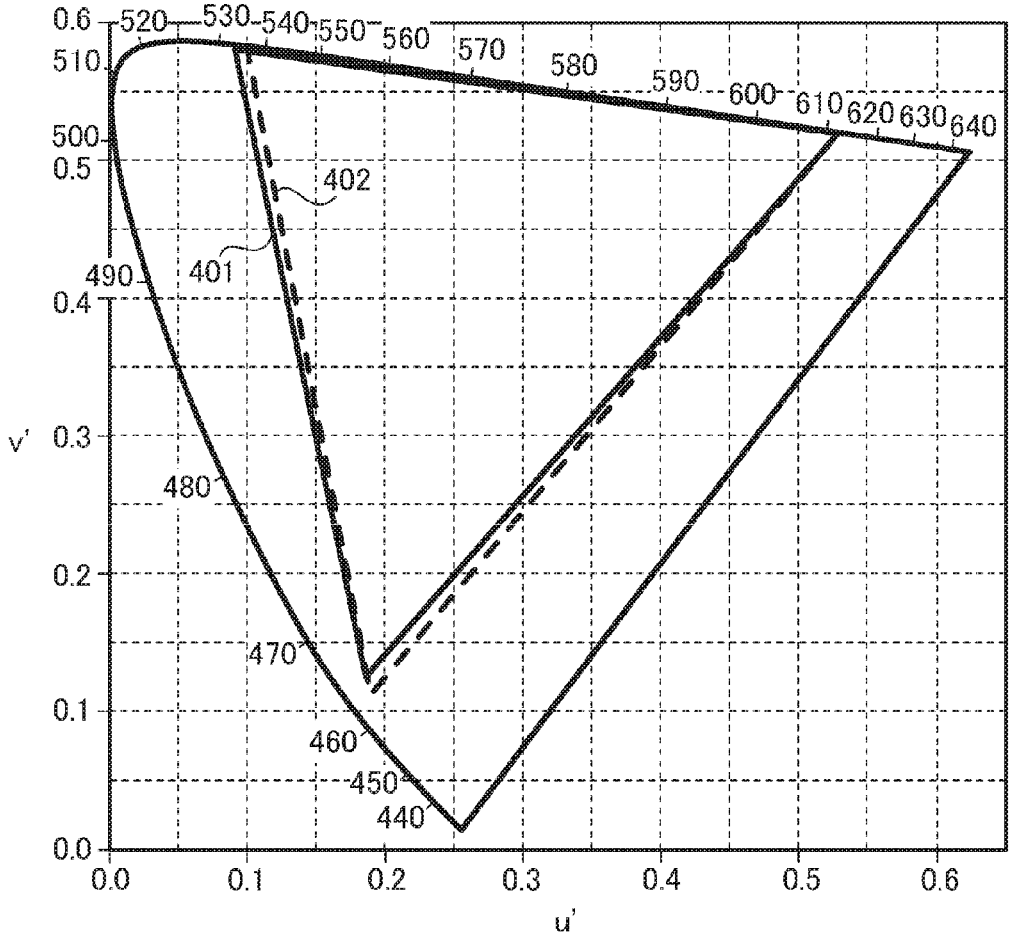
FIG. 17 shows one example of a range of display color relating to the first embodiment.

FIG. 17 is a chromaticity diagram showing one example of the range of the display color (the on-screen color) according to the first embodiment. FIG. 17 is a u'v' chromaticity diagram (CIE 1976 UCS chromaticity diagram). The triangular shape 401 demarcated by the solid lines shows the range of the display color in a case where the LD mode is set, and the triangular shape 402 demarcated by the solid lines shows the range of the display color in a case where the non-LD mode is set.

The three vertices of the triangles 401, 402 are the red chromaticity point, the green chromaticity point and the blue chromaticity point. Here, the pixel values of the image data are RGB values (R value, G value, B value), and the gradation values (R value, G value and B value) are values from 0 to 255. The red chromaticity point is a chromaticity point of the display color having an RGB value (255,0,0), and is a vertex point near (u',v')=(0.5,0.5). The green chromaticity point is a chromaticity point of the display color having an RGB value (0,255, 0), and is a vertex point near (u',v')=(0.1,0.6). The blue chromaticity point is a chromaticity point of the display color having an RGB value (0,0,255), and is a vertex point near (u',v')=(0.2,0.1).

In the non-LD mode of the first embodiment, only the drive current value of the G-LEDs is controlled to a smaller value than the LD mode. Therefore, in the non-LD mode, the light emission wavelength λd of the G-LEDs is displaced to the long wavelength side compared to the LD mode. For example, the light emission wavelength λd of the G-LEDs is displaced by +4 nm. If the light emission wavelength λd of the G-LED is 530 (nm) in a case where the LD mode is set, the light emission wavelength λd of the G-LED in a case where the non-LD mode is set is 534 (nm). As a result of this, a chromaticity point displaced to the long wavelength side from the triangle 401 is obtained as the green chromaticity point, as shown by the triangle 402. Furthermore, the blue chromaticity point is displaced to the short wavelength side by shifting the light emission wavelength λd of the G-LEDs to the long wavelength side. This is because the spectrum of green light that leaks out in a case of displaying a blue color is reduced. In this way, in the method according to the first embodiment, there is a displacement of two points which are the green chromaticity point and the blue chromaticity point, between the LD mode and the non-LD mode. In a case where there is a displacement of the two points in this way, a large variation (error) occurs in the display color and the range thereof.

Figure 18:
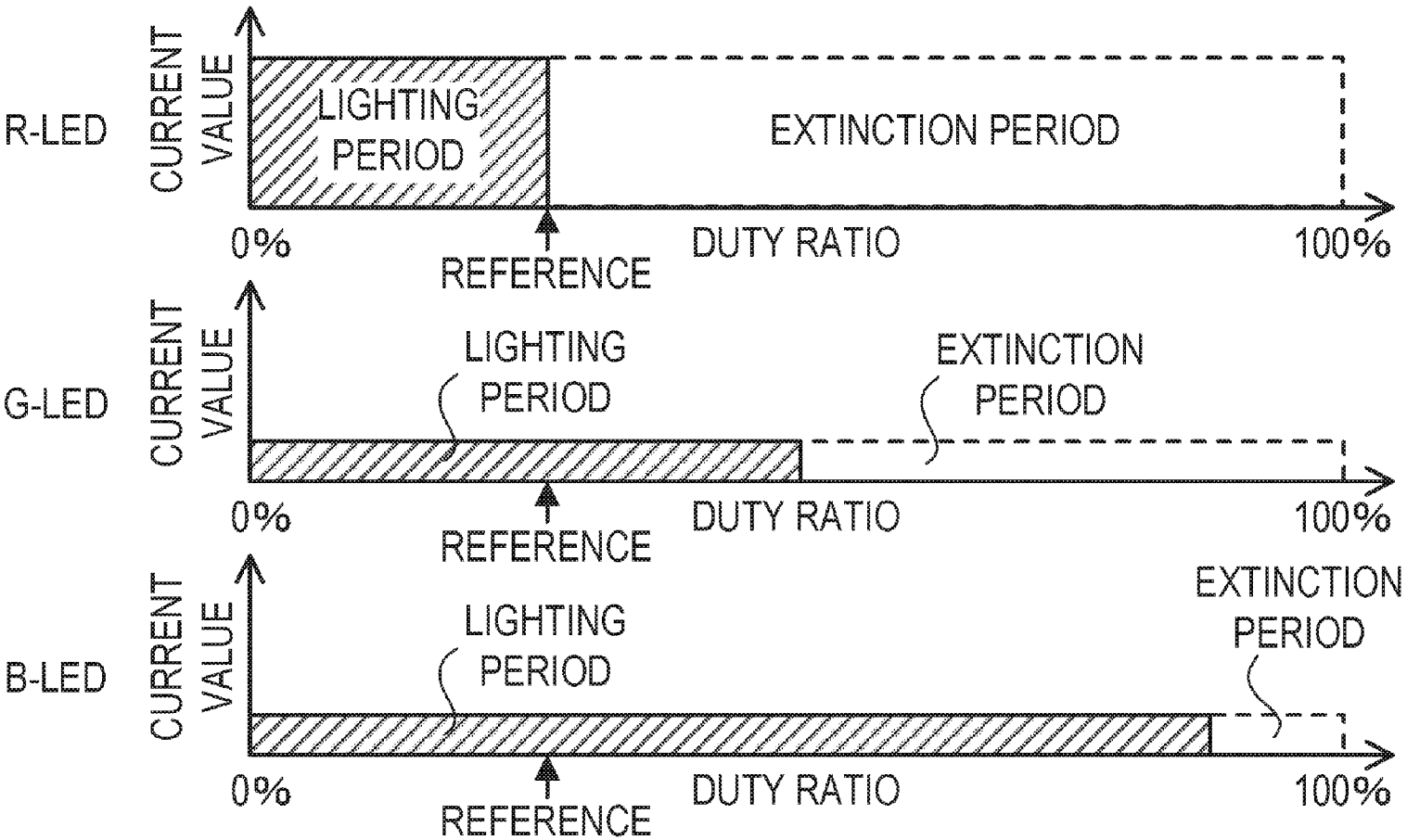
FIG. 18 shows one example of the drive current value and duty ratio relating to a third embodiment.

FIG. 18 is a graph showing one example of the drive current value and the duty ratio for non-LD mode relating to the present embodiment. As shown in FIG. 18, in the present embodiment, a value that is lower than the reference current value is set as the drive current value for the B-LEDs and a value that is lower than the reference duty ratio is set as the duty ratio of the B-LEDs. The R-LEDs and G-LEDs are the same as in the first embodiment. More specifically, the same value as the G-LEDs, 25 (mA), is set as the drive current value for the B-LEDs. On the other hand, a value that is higher than the G-LEDs is set as the duty ratio of the B-LEDs. This is because improvement in the power efficiency can be expected due to reduction of the drive current value in the G-LEDs, but significant improvement cannot be expected in the B-LEDs.

Figure 19:
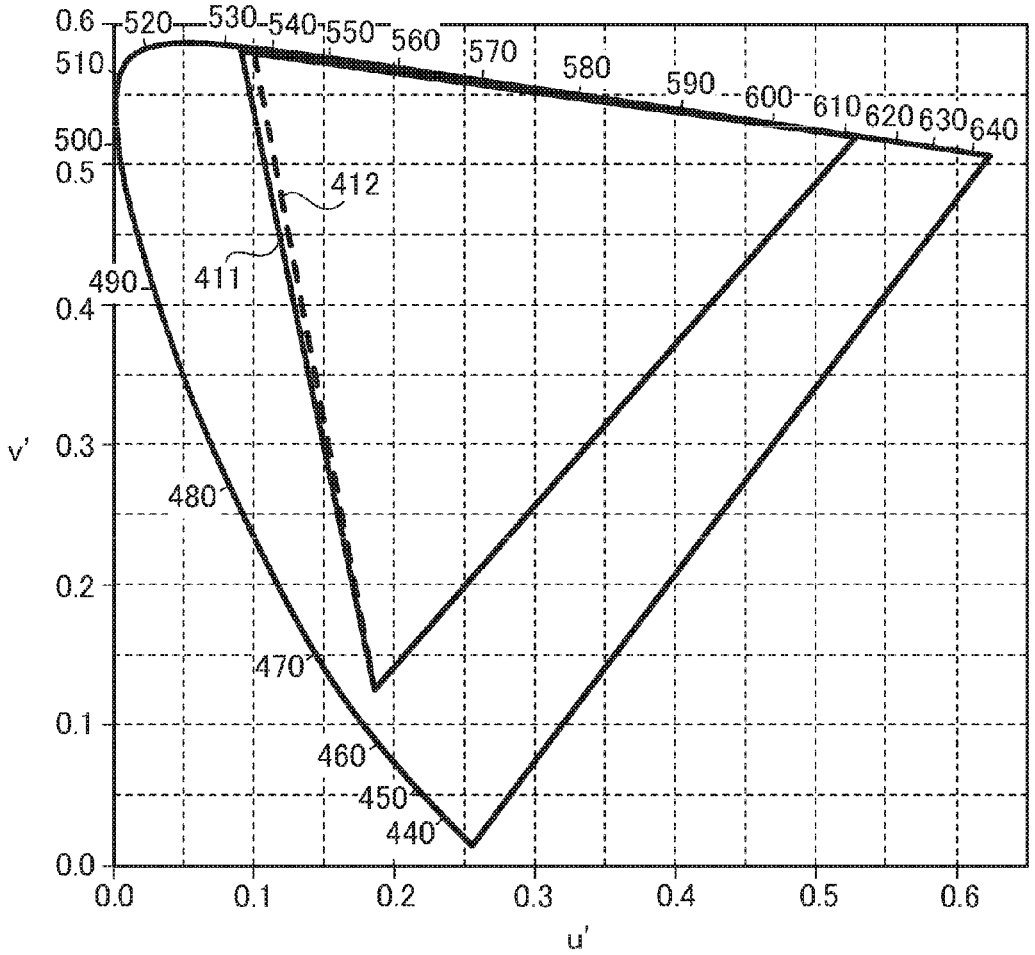
FIG. 19 shows one example of a range of display color relating to the third embodiment.

FIG. 19 is a chromaticity diagram showing one example of the range of a display color relating to the present embodiment. The triangle 411 demarcated by the solid lines indicates the range of the display color in a case where the LD mode is set, which is the same as the triangle 401 in FIG. 17. The triangle 412 demarcated by the dotted line indicates the range of the display color in a case where the non-LD mode according to the present embodiment is set.

In the non-LD mode of the present embodiment, the drive current value of the G-LEDs and the B-LEDs is controlled to a smaller value than the LD mode. Therefore, in the non-LD mode, the light emission wavelength λd of the G-LEDs and the B-LEDs is displaced to the long wavelength side compared to the LD mode. For example, the light emission wavelength λd of the G-LEDs is displaced by +4 nm, and the light emission wavelength λd of the B-LEDs is displaced by 2 nm. As a result of this, a chromaticity point displaced to the long wavelength side from the triangle 411 is obtained as the green chromaticity point, as shown by the triangle 412. On the other hand, there is little displacement of the blue chromaticity point. This is because reduction in the spectrum of green light that leaks out during display of a blue color is suppressed by displacing the light emission wavelength λd of both the G-LEDs and the B-LEDs to the long wavelength side. In this way, in the present embodiment, there is little displacement of the chromaticity points apart from the green chromaticity point, between the LD mode and the non-LD mode, and therefore it is possible to reduce error in the display color and the range thereof.

As described above, according to the present embodiment, the light emission of the G-LEDs is controlled similarly to the first embodiment. Therefore, it is possible to reduce the power consumption of the light source apparatus, without carrying out local dimming control. Furthermore, according to the present embodiment, based on the following assumption, the drive current value of the B-LEDs is lower and the lighting period of the B-LEDs is longer in the second mode (non-LD mode) than in the first mode (LD mode). Consequently, it is possible to reduce variation in the light emission color of the LED substrate 101 due to change in the drive current value. Assumption: The B-LEDs are driven in such a manner that the light emission brightness of the B-LEDs substantially coincides between the first mode and the second mode.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-064872, filed on Mar. 26, 2015, which is hereby incorporated by reference herein in its entirety.

What is claimed is:

1. A light source apparatus, comprising:

a light-emitting unit having a plurality of light-emitting diodes having mutually different light emission colors;

at least one processor; and at least one memory storing a program which, when executed by the at least one processor, causes the light source apparatus to:

set any of a plurality of drive modes including a first drive mode and a second drive mode having mutually different drive methods for the light-emitting unit; and drive the light-emitting unit in such that each of the plurality of light-emitting diodes emits light periodically, by a drive method corresponding to the set drive mode, wherein the plurality of light-emitting diodes include a G-LED which is a light-emitting diode that emits green light; and in a case where the light-emitting unit is lit with a predetermined light emission brightness, the current supplied to the G-LED in the lighting period of the G-LED is lower, and the lighting period of the G-LED in one cycle of light emission of the G-LED is longer in the second drive mode than those in the first drive mode.

2. The light source apparatus according to claim 1, wherein the first drive mode is a drive mode which changes at least one of the light emission brightness and the light emission color of the light-emitting unit in accordance with input image data; and the second drive mode is a drive mode which does not change the light emission brightness and the light emission color of the light-emitting unit in accordance with the input image data.

3. The light source apparatus according to claim 2, wherein the light-emitting unit has the plurality of light-emitting diodes respectively for a plurality of partial regions in a region of a light-emitting surface of the light-emitting unit;

the first drive mode is a drive mode which individually changes at least one of the light emission brightness and the light emission color of the light-emitting unit, in each of the plurality of partial regions; and the second drive mode is a drive mode which makes the light emission brightness and the light emission color of the light-emitting unit substantially coincide between the plurality of partial regions.

4. The light source apparatus according to claim 2, wherein the second drive mode is a drive mode which causes the light-emitting unit to emit light with a light emission brightness that is higher than an upper limit of the light emission brightness of the light-emitting unit in a case where the first drive mode is set.

5. The light source apparatus according to claim 1, wherein in a case where assumption is made that the G-LED is driven such that the light emission brightness of the G-LED substantially coincides between the first drive mode and the second drive mode, the current supplied to the G-LED in the lighting period of the G-LED is lower, and the lighting period of the G-LED in one cycle of light emission of the G-LED is longer in the second drive mode than those in the first drive mode.

6. The light source apparatus according to claim 5, wherein the plurality of light-emitting diodes further include a B-LED which is a light-emitting diode that emits blue light; and in a case where assumption is made that the B-LED is driven such that the light emission brightness of the B-LED substantially coincides between the first drive mode and the second drive mode, the current supplied to the B-LED in the lighting period of the B-LED is lower, and the lighting period of the B-LED in one cycle of light emission of the B-LED is longer in the second drive mode than those in the first drive mode.

7. The light source apparatus according to claim 5, wherein the G-LED is a gallium nitride type semiconductor LED.

8. The light source apparatus according to claim 5, wherein light emission efficiency of the G-LED is lower than light emission efficiency of other light-emitting diodes included in the plurality of light-emitting diodes.

9. The light source apparatus according to claim 6, wherein the B-LED is a gallium nitride type semiconductor LED.

10. The light source apparatus according to claim 1, wherein the light emission brightness of the light-emitting unit can be changed by adjusting at least one of a pulse width and a pulse amplitude of a pulse signal of a current that is supplied to the light-emitting diode.

11. The light source apparatus according to claim 1, wherein, in a case where the light-emitting unit is lit with a predetermined light emission brightness, the drive current value in the lighting period and the lighting period in one cycle, in the second mode, are equal to those in the first drive mode, in the light-emitting diodes other than the G-LED from among the plurality of light-emitting diodes.

12. An image display apparatus, comprising:

a light source apparatus; and a display panel for displaying an image on a screen by modulating light from the light source apparatus on the basis of input image data, wherein the light source apparatus comprises a light-emitting unit having a plurality of light-emitting diodes having mutually different light emission colors, at least one processor; and at least one memory storing a program which, when executed by the at least one processor, causes the light source apparatus to:

set any of a plurality of drive modes including a first drive mode and a second drive mode having mutually different drive methods for the light-emitting unit, and drive the light-emitting unit in such that each of the plurality of light-emitting diodes emits light periodically, by a drive method corresponding to the set drive mode; wherein the plurality of light-emitting diodes include a G-LED which is a light-emitting diode that emits green light; and in a case where the light-emitting unit is lit with a predetermined light emission brightness, the current supplied to the G-LED in the lighting period of the G-LED is lower, and the lighting period of the G-LED in one cycle of light emission of the G-LED is longer in the second drive mode than those in the first drive mode.

13. The image display apparatus according to claim 12, wherein the setting unit sets any of the plurality of drive modes in accordance with input image data.

14. The image display apparatus according to claim 12, wherein the setting unit sets any of the plurality of drive modes in accordance with a user operation.

15. The image display apparatus according to claim 14, wherein the user operation is a user operation that is different from a user operation for selecting of the plurality of drive modes.

16. A control method executed by at least one processor of a light source apparatus including a light-emitting unit having a plurality of light-emitting diodes having mutually different light emission colors, comprising:

setting any of a plurality of drive modes including a first drive mode and a second drive mode having mutually different drive methods for the light-emitting unit; and driving the light-emitting unit in such that each of the plurality of light-emitting diodes emits light periodically, by a drive method corresponding to the drive mode set by the setting, wherein the plurality of light-emitting diodes include a G-LED which is a light-emitting diode that emits green light; and in a case where the light-emitting unit is lit with a predetermined light emission brightness, the current supplied to the G-LED in the lighting period of the G-LED is lower, and the lighting period of the G-LED in one cycle of light emission of the G-LED is longer in the second drive mode than those in the first drive mode.

* * * * *